US010878797B2

(12) United States Patent
Christian et al.

(10) Patent No.: US 10,878,797 B2
(45) Date of Patent: Dec. 29, 2020

(54) FREQUENCY-BASED CAUSALITY BINARY LIMITER FOR ACTIVE NOISE CONTROL SYSTEMS

(71) Applicant: Harman International Industries, Incorporated, Stamford, CT (US)

(72) Inventors: Jonathan Wesley Christian, Milford, MI (US); Kevin J. Bastyr, Franklin, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/646,903

(22) PCT Filed: Sep. 14, 2018

(86) PCT No.: PCT/US2018/051056

§ 371 (c)(1),
(2) Date: Mar. 12, 2020

(87) PCT Pub. No.: WO2019/055769

PCT Pub. Date: Mar. 21, 2019

(65) Prior Publication Data

US 2020/0279548 A1 Sep. 3, 2020

Related U.S. Application Data

(60) Provisional application No. 62/559,033, filed on Sep. 15, 2017, provisional application No. 62/641,634, (Continued)

(51) Int. Cl.
*G10K 11/178* (2006.01)
*H04R 3/00* (2006.01)

(52) U.S. Cl.
CPC ..... *G10K 11/17854* (2018.01); *G10K 2210/1282* (2013.01); *G10K 2210/3028* (2013.01)

(58) Field of Classification Search
CPC . H04R 3/00; H04R 3/005; H04R 3/04; H04R 1/1083; G10K 11/178;
(Continued)

(56) References Cited

U.S. PATENT DOCUMENTS 4,628,530 A * 12/1986 Op De Beek ..... H03G 5/165 381/103
5,245,664 A 9/1993 Kinoshite et al.
(Continued)

*Primary Examiner* — Thang V Tran
(74) *Attorney, Agent, or Firm* — Brooks Kushman, P.C.

(57) ABSTRACT

A propagation delay identification system for active noise cancelation for a vehicle audio system may include at least one sensor configured to transmit sensor data indicative of acceleration data, hammer data and microphone data, at least one output sensor configured to transmit an impulse response, and a processor. The processor may be programmed to receive the sensor data and pulse function, identify a propagation path delay between the microphone data and a cross-correlation between the acceleration data and hammer data, and generate a source pulse function. The processor further identify a secondary path delay based on an arrival time of peak energy of a convolution of the impulse response and filtered pulse function, and apply a binary limiter to a reference signal in response to the secondary path delay exceeding the propagation path delay to reduce boosting of an audio signal based on coherent reference and error signals.

16 Claims, 23 Drawing Sheets

Related U.S. Application Data filed on Mar. 12, 2018, provisional application No. 62/641,631, filed on Mar. 12, 2018.

(58) Field of Classification Search

CPC ..... G10K 11/17815; G10K 11/17817; G10K 11/17854; G10K 11/17881; G10K 11/17883; G10K 2210/1283; G10K 2210/3028

See application file for complete search history.

(56) References Cited

U.S. PATENT DOCUMENTS

| | | | | | |
|---|---|---|---|---|---|
| 5,377,276 | A * | 12/1994 | Terai | G10K 11/178 | 381/71.11 |
| 5,602,927 | A | 2/1997 | Tamamura et al. | | |
| 5,610,909 | A * | 3/1997 | Shaw | H04M 9/082 | 370/291 |
| 2002/0003887 | A1* | 1/2002 | Zhang | G10K 11/17825 | 381/71.1 |
| 2005/0175187 | A1 | 8/2005 | Wright et al. | | |
| 2006/0061414 | A1 | 3/2006 | North | | |
| 2010/0014685 | A1* | 1/2010 | Wurm | G10K 11/17881 | 381/71.11 |
| 2010/0195844 | A1* | 8/2010 | Christoph | G10K 11/178 | 381/71.11 |
| 2014/0070935 | A1 | 3/2014 | Wang et al. | | |
| 2016/0163304 | A1* | 6/2016 | Lee | G10K 11/17879 | 381/71.4 |
| 2017/0178617 | A1* | 6/2017 | Christoph | G10K 11/17853 | |
| 2018/0240452 | A1* | 8/2018 | Every | G10K 11/178 | |

* cited by examiner

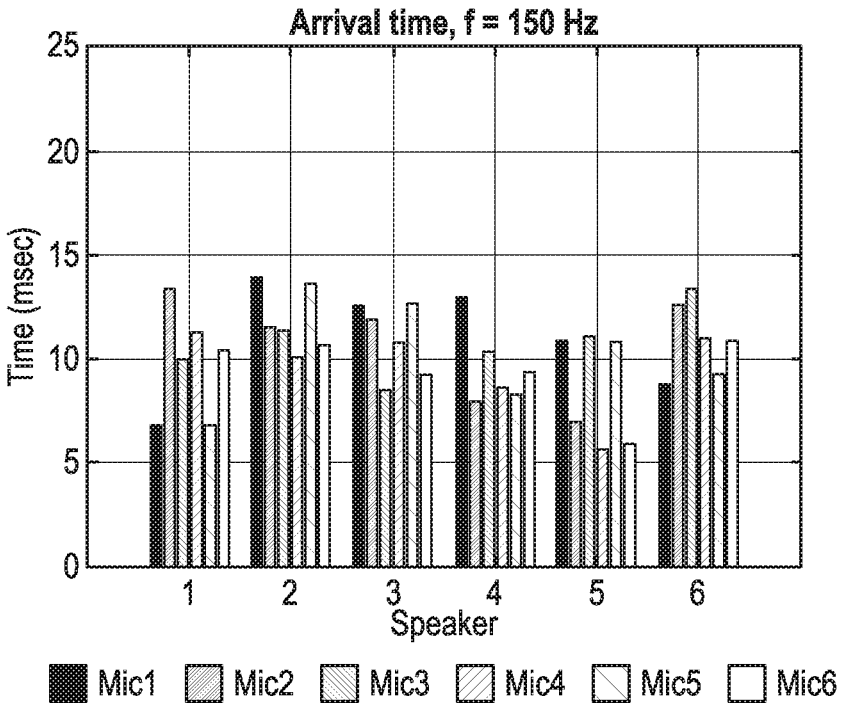
*Fig.* 15C
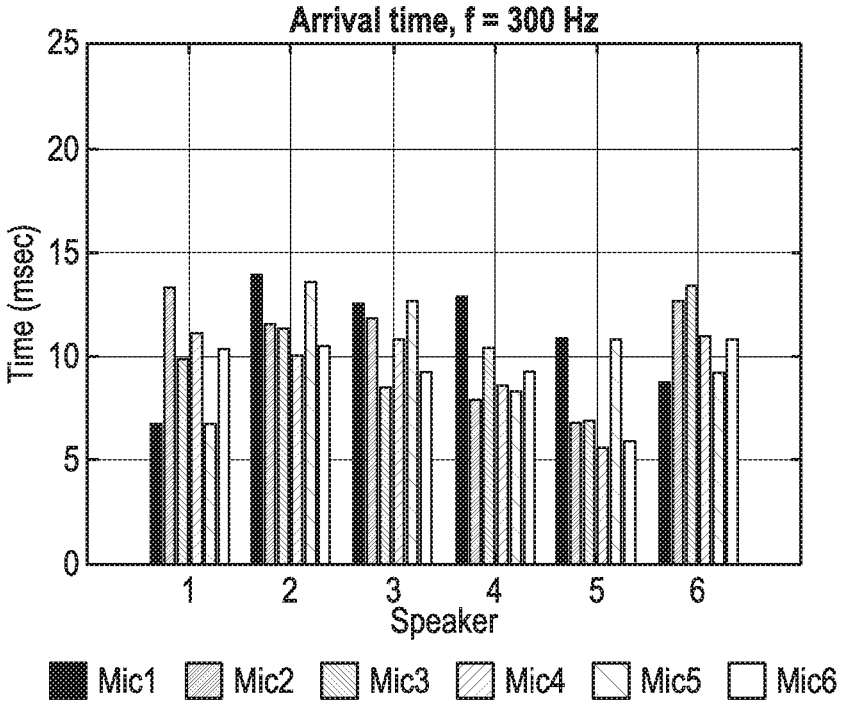
*Fig.* 15D

FREQUENCY-BASED CAUSALITY BINARY LIMITER FOR ACTIVE NOISE CONTROL SYSTEMS

CROSS-REFERENCE TO RELATED APPLICATIONS

This application is the U.S. National Phase of PCT/US2018/051056 filed Sep. 14, 2018, which claims the benefit of U.S. provisional application Ser. No. 62/641,634 filed Mar. 12, 2018, U.S. provisional application Ser. No. 62/641,631 filed Mar. 12, 2018, and U.S. provisional application Ser. No. 62/559,033 filed Sep. 15, 2017, the disclosures of which are hereby incorporated in their entirety by reference herein.

TECHNICAL FIELD

Disclosed herein are propagation delay identification system for complex structures.

BACKGROUND

Vehicles often generate structural-borne noise when driven. In an effort to cancel the noise, active noise cancellation is often used to negate such noise by emitting a sound wave having an amplitude similar to the amplitude as that of the road noise, but with an inverted phase. The effectiveness of such active noise cancellation is often dependent on various delays throughout the structure. Noise cancelations systems may attempt to prevent the sound wave from creating more noise (e.g., boosting) for frequency content that is not highly coherent and/or not causal between a set of reference and error signals.

SUMMARY

A propagation delay identification system for active noise cancelation for a vehicle audio system may include at least one sensor configured to transmit sensor data indicative of acceleration data, hammer data and microphone data, at least one output sensor configured to transmit an impulse response, and a processor. The processor may be programmed to receive the sensor data and pulse function, identify a propagation path delay between the microphone data and a cross-correlation between the acceleration data and hammer data, and generate a source pulse function. The processor may further be programmed to apply a bandpass filter to the pulse function, identify a secondary path delay based on an arrival time of peak energy of a convolution of the impulse response and filtered pulse function, and apply a binary limiter to a reference signal in response to the secondary path delay exceeding the propagation path delay to reduce boosting of an audio signal based on coherent reference and error signals.

A method for identifying the propagation delay identification for active noise cancelation for a vehicle audio system may include receiving sensor data including acceleration data, hammer data, and microphone data, receiving at least one impulse response at an output sensor, and identifying a propagation path delay between the microphone data and a cross-correlation between the acceleration data and hammer data. The method may further include generating a source pulse function, applying a bandpass filter to the pulse function, identifying a secondary path delay based on an arrival time of peak energy of a convolution of the impulse response and filtered pulse function, and applying a binary limiter to a reference signal in response to the secondary path delay exceeding the propagation path delay to reduce boosting of an audio signal based on coherent reference and error signals.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

FIGS. 15A-F illustrate example results of arrival times for various speakers at various frequencies;

DETAILED DESCRIPTION

Figure 1:
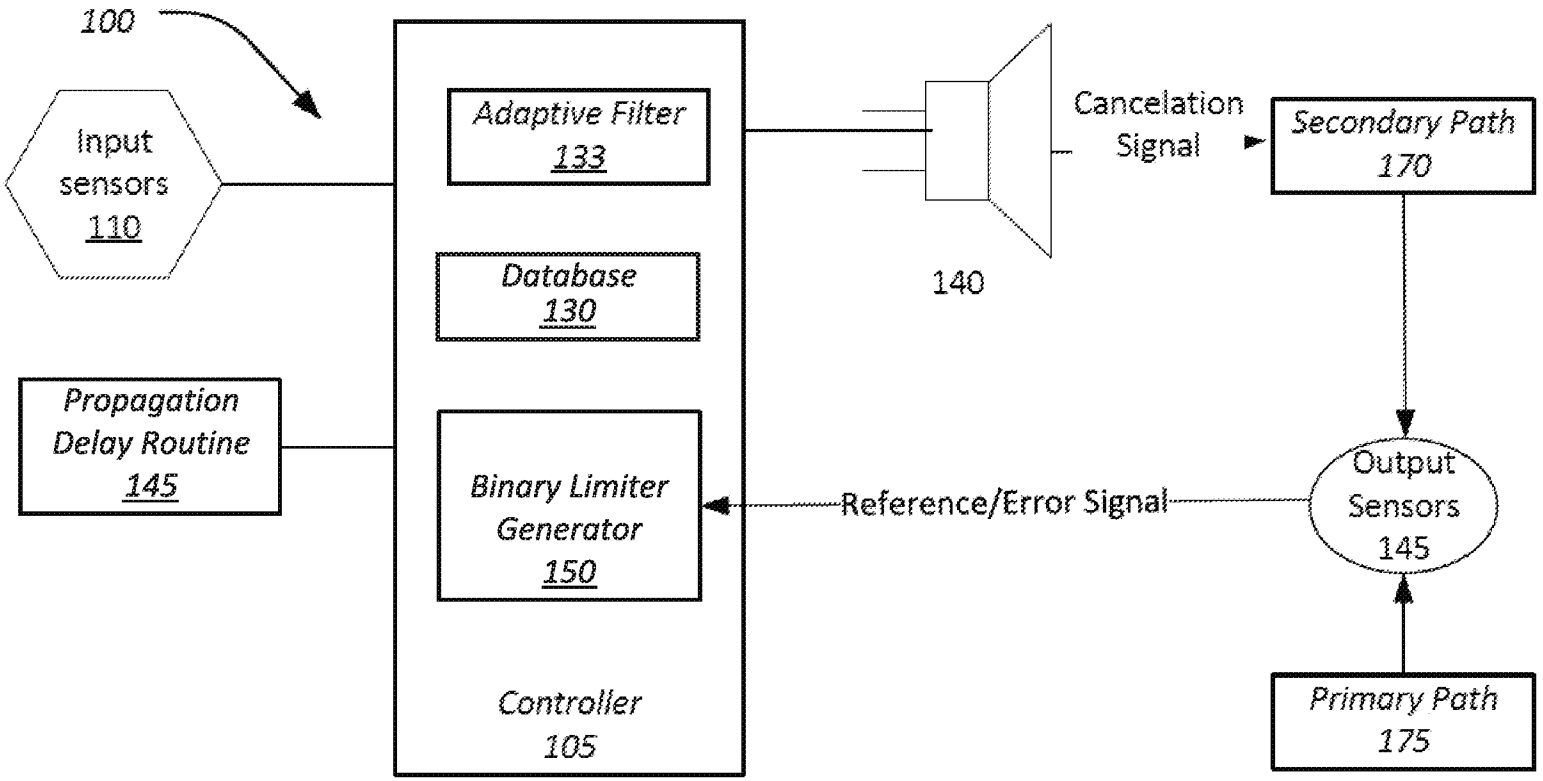
FIG. 1 illustrates an example propagation delay identification system in accordance with one embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

During noise cancellation in vehicles, filters are often used to reduce road noise and improve the listening experience within the vehicle cabin. The noise cancellation may depend on a propagation delay through the vehicle. The propagation delay is the amount of time for a signal to reach its destination. A noise cancellation system may include various requirements and parameters defined by the propagation delay. For example, the total electroacoustic delay of the noise cancelation system should be less than the propagation delay for optimal cancelation. Identifying the propagation delay, however, may be difficult, especially through a complex structure due to the multiple paths and dispersion effects. A short propagation delay may result in the noise cancelation system latency being too high, which in turn may affect the cancelation performance.

Disclosed herein is a system that generates an accurate propagation delay and identifies the actual propagation path through a complex structure that was otherwise impossible to determine empirically. The disclosed system may be suitable for simple or extremely complex structures, as well as for noisy environments which may otherwise contaminate the test data.

In general, the system takes impulse measurements done on a structure and looks first at the accelerometer and hammer data. Here, the accelerometer data may be decorrelated using principal component analysis (PCA), or singular value decomposition. New accelerometer signals may be reconstructed from the principal components and the original data. The cross-correlation between the virtual signal and the actual hammer signal may be computed in which the peak in this function represents the time lag, or propagation delay of that pulse to this particular location. The absolute value of that function is taken so that the peak can be clearly identified and this value recorded. The propagation path itself is characterized by taking these arrival times and plotting them versus the accelerometer number to identify the actual path as the vibration energy transfers through the structure toward the cabin.

The arrival time of the last known structural point that is joined to the body should be a couple of milliseconds before the arrival time of the pulse to the microphone. This arrival time at the microphone is identified by looking at the first peak in the cross-correlation function between the actual mic and the hammer signals. Essentially, the pulse is followed through the structure in order to better identify the actual arrival of the pulse at the microphone.

The secondary path propagation delay system may apply a filter to the source pulse and convolve it with the secondary path impulse response to identify the arrival time of a peak energy.

Further, when tuning noise cancelation systems, efforts are made to prevent boosting for frequency content that may not be highly coherent, and/or non-causal, between a set of frequency and error signals. Such tuning may take considerable processing and increase the necessary tuning time. In an effort to reduce the tuning time, and likely improve RNC performance, the non-causal portion of the reference or error signals may be removed.

This may be accomplished during an off-line calculation. As explained, the calculation may identify the frequency dependent delays both in the primary path and the secondary path. These data sets are compared offline, creating a set of static binary limiters. The limiters are enacted on either the references signal and/or the error signal.

In typical noise cancelation, the example may arise where the reference/error signals are coherent, but not causal. As a result of this, boosting is likely to occur as the delay from the secondary path for those given frequencies will exceed the delay of the primary path. Thus, the proper phase alignment of the anti-noise signal may not be accurately generated.

The causality criteria requires that the primary path propagation delay be greater than the secondary path propagation delay. If this is not the case, then cancelation may not be possible or the resulting cancelation will be minimal.

FIG. 1 illustrates an example propagation delay identification system 100 having a controller 105, at least one input sensor 110, and a database 130. The controller 105 may be a stand-alone device that include a combination of both hardware and software components and may include a processor configured to analyze and process audio signals. Specifically, the controller 105 may be configured to perform broadband and narrowband noise cancellation, as well as active road noise cancellation (ARNC), within a vehicle based on received data from the input sensor 110. The controller 105 may include various systems and components for achieving ARNC such as the database 130, an adaptive filter 133, and a propagation delay identification routine 145.

The input sensor 110 is configured to provide an input signal to the controller 105. The input sensor 110 may include an accelerometer configured to detect motion or acceleration and to provide an accelerometer signal to the controller 105. The acceleration signal may be indicative of a vehicle acceleration, engine acceleration, wheel acceleration, etc. The input sensor 110 may also include a microphone configured to detect noise.

At least one adaptive filter 133 may be included in the system 100 for providing a noise cancellation signal to a transducer 140. The transducer 140 may be configured to audibly generate an audio signal provided by the controller 105 at an output channel (not labeled). In one example, the transducer 140 may be included in a motor vehicle. The vehicle may include multiple speakers arranged throughout the vehicle in various locations such as the front right, front left, rear right, and rear left. The audio output at each transducer 140 may be controlled by the controller 105 and may be subject to noise cancellation, as well as other parameters affecting the output thereof. In one example, the fade settings may mute one or more speakers. In another example, the gain at one speaker may be greater than the others. These parameters may be in response to certain user defined settings and preferences (e.g., setting the fader), as well as preset audio processing effects. The transducer 140 may provide the noise cancellation signal to aid in the ARNC to improve the sound quality within the vehicle.

The propagation delay identification routine 145 may be configured to use accelerometer data and hammer data, as well as microphone data, to determine various arrival times of pulses and thus determine the propagation delay. This is discussed in more detail with respect to FIG. 2.

The propagation delay identification system 100 may use cross-correlation techniques to identify various delays or lags of signals. The impulse response of the secondary path may be used to identify lags or delays by choosing peaks in the signals. In some examples, these peaks may be selected at random. However, this may not be the most accurate way to determine a lag and identify a signal path. Another mechanism is to select peaks of a signal that exceed a certain signal-to-noise ratio. Various other mechanisms may also be used.

Principal component analysis (PCA) may also be used to emphasize variation and bring out strong patterns in a dataset. The PCA may compute the most meaningful basis to re-express a noisy data set. The PCA may determine that the unit base vector along the x-axis to determine which dynamics are important and which are redundant. Generally, each data sample is a vector having an m number of meaningful measurement types. Every time sample is a vector that lies in an m-dimensional vector space spanned by orthonormal basis. All measurement vectors in this space are in linear combination of this set of unit length basis vectors. Such PCA may rely on various original basis, change of the basis, rotation and stretch of various vectors, and linearity. Furthermore, common measurements such as signal-to-noise ratios, or ratio of variances may be used. This method is further explained in "A Tutorial on Principal Component Analysis, Derivation, Discussion and Singular Value Decomposition," by John Shlens, 25 Mar. 2003, which is hereby incorporated by reference.

The active noise cancellation (ANC) system 100 may include output sensors 145. An output sensor 145 may be a microphone arranged on a secondary path 170 and may receive audio signals from the transducer 140. The output sensor 145 may be a microphone configured to transmit a microphone output signal to the controller 105. The microphone output signal may be configured as the feedback signal (reference/error signal) for purposes of noise cancellation. The output sensor 145 may be configured to detect an auto spectra of the output channel. The output sensor 145 may provide the microphone output signal including a power spectrum indicative of a distribution of power into frequency components. The microphone output signal may be used to determine the impulse response. The output sensor 145 may also receive undesired noise from the vehicle such as the road noise, at a primary path 175, and the microphone output signal may include an undesired noise signal 177 in addition to the noise cancellation signal.

The ANC system 100 may include a binary limiter generator 150. The binary limiter generator 150 may be an off-line system for creating a set of static binary limiters to be applied to the reference/error signals. The binary limiters may be generated based on frequency dependent delays in both the primary path and the secondary path. The binary limiter generator 150 is described in more detail in FIG. 2.

The impulse response of signals may be used to identify lags or delays by choosing peaks in the signals. The secondary path propagation delay system may apply a filter to the source pulse and convolve it with the secondary path impulse response to identify the arrival time of a peak energy.

As explained above, the output sensors 145 may provide a filtered output signal that includes cabin acoustics such as attenuation, amplification, and delay. The IR of the of the secondary path in the time domain may be represented as:

$$IR(t) = IFFT\left(\frac{FFT(\text{mic signal})}{FFT(\text{source signal})}\right)$$

Figure 2:
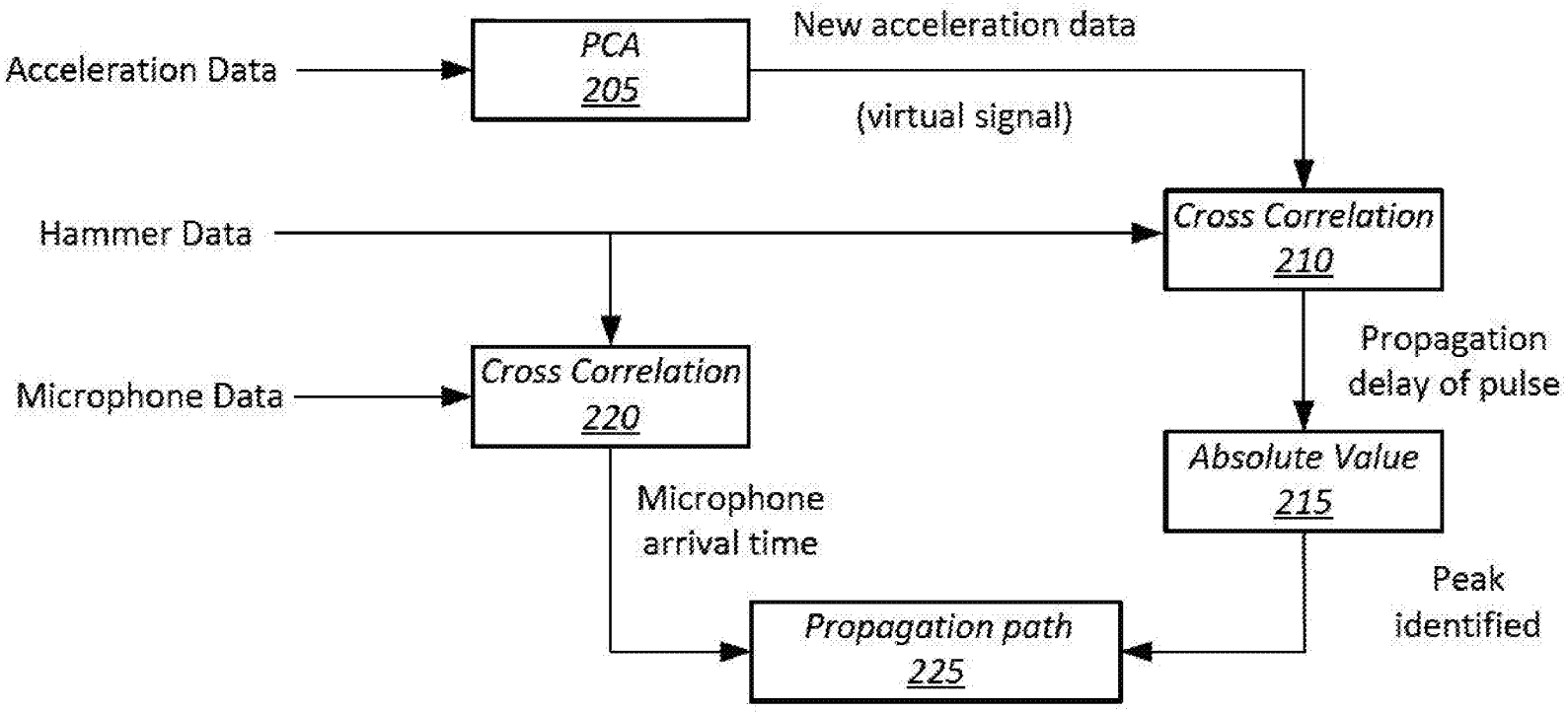
FIG. 2 illustrates an example system flow for determining the propagation delay.

FIG. 2 illustrates an example system flow 200 for determining the propagation delay.

Figure 4:
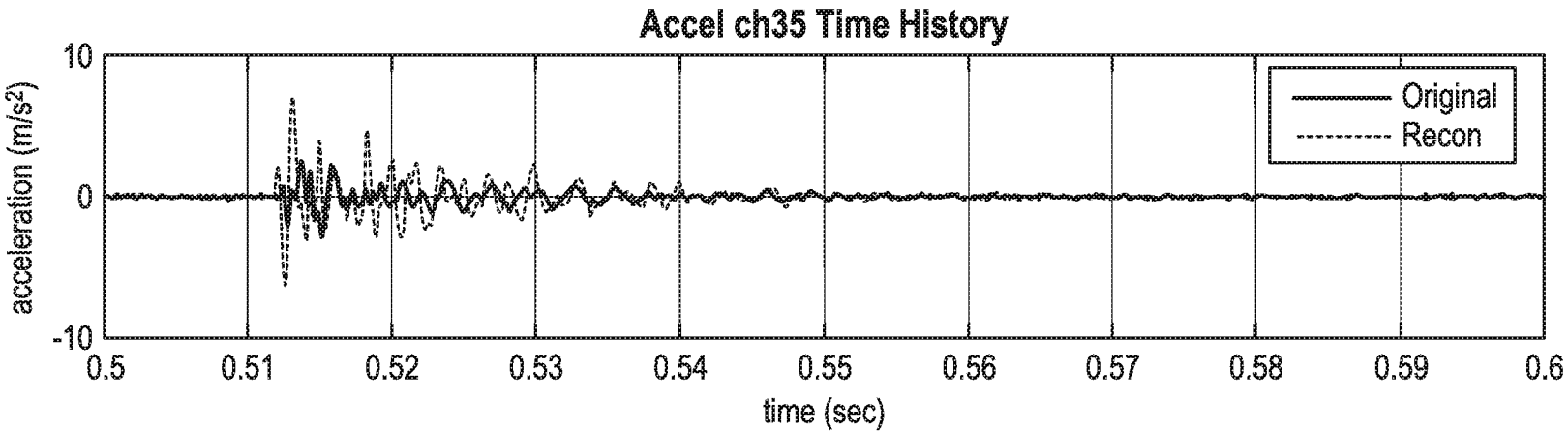
FIG. 4 illustrates an example chart showing the acceleration data.

The system 100, via the controller 105, may decorrelate the acceleration data using principal component analysis (PCA) or singular value decomposition at block 205. New acceleration data may be reconstructed from the principal components and the original data. An example chart showing the acceleration data is shown in FIG. 4. While reference is made to the controller 105, the processing may be accomplished off-line by a another processor or controller.

At block 210, the controller 105 may cross-correlate the virtual signal or the new acceleration data and the hammer data.

Figure 6:
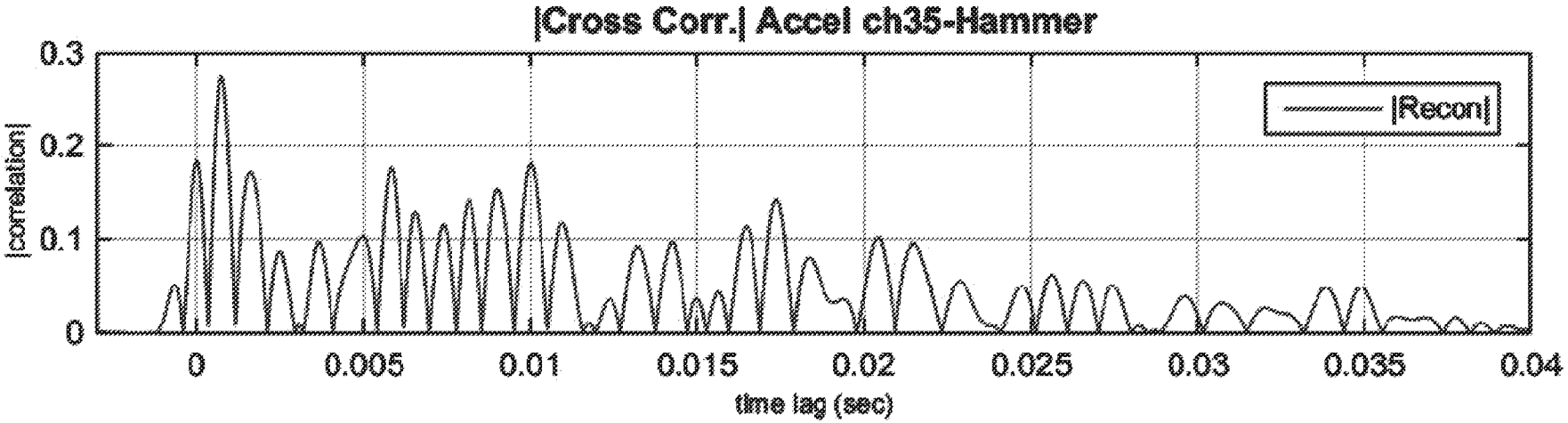
FIG. 6 illustrates an example chart showing the absolute value of the cross-correlation of FIG. 5.

At block 215, the controller 105 may take the absolute value of the cross-correlation function to identify the peak and record the value thereof. An example chart showing the absolute value of the cross-correlation is shown in FIG. 6. Referring ahead to FIG. 6, the highest peak in the magnitude of the cross-correlation may traditionally identified as the arrival time. User thresholds may be used, however. For example, if an earlier peak is within that threshold, this may be identified as the arrival time, as opposed to the highest peak.

Figure 8:
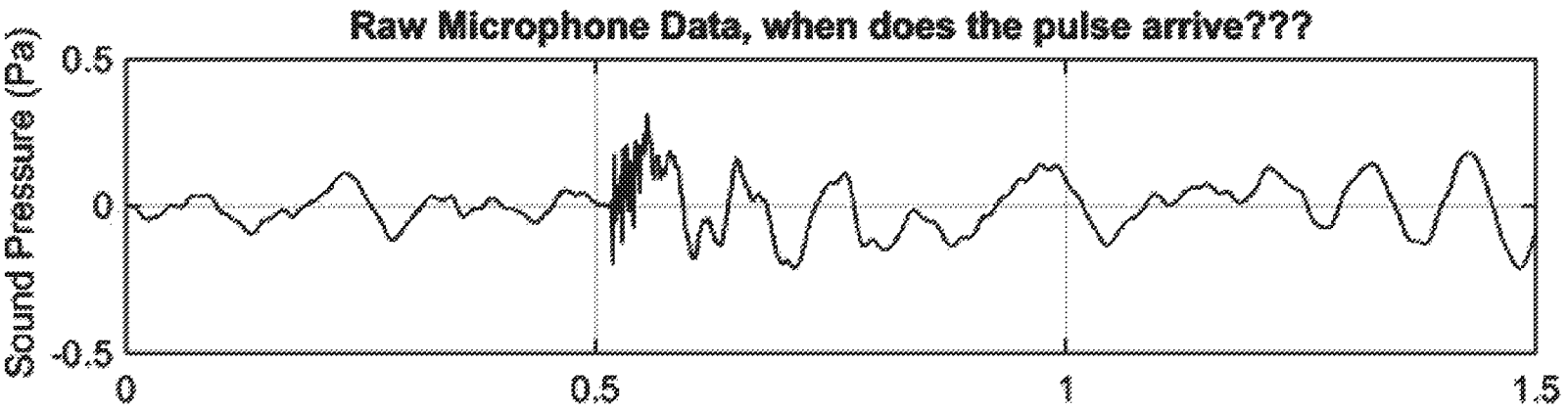
FIG. 8 illustrates an example chart showing microphone data.
Figure 9:
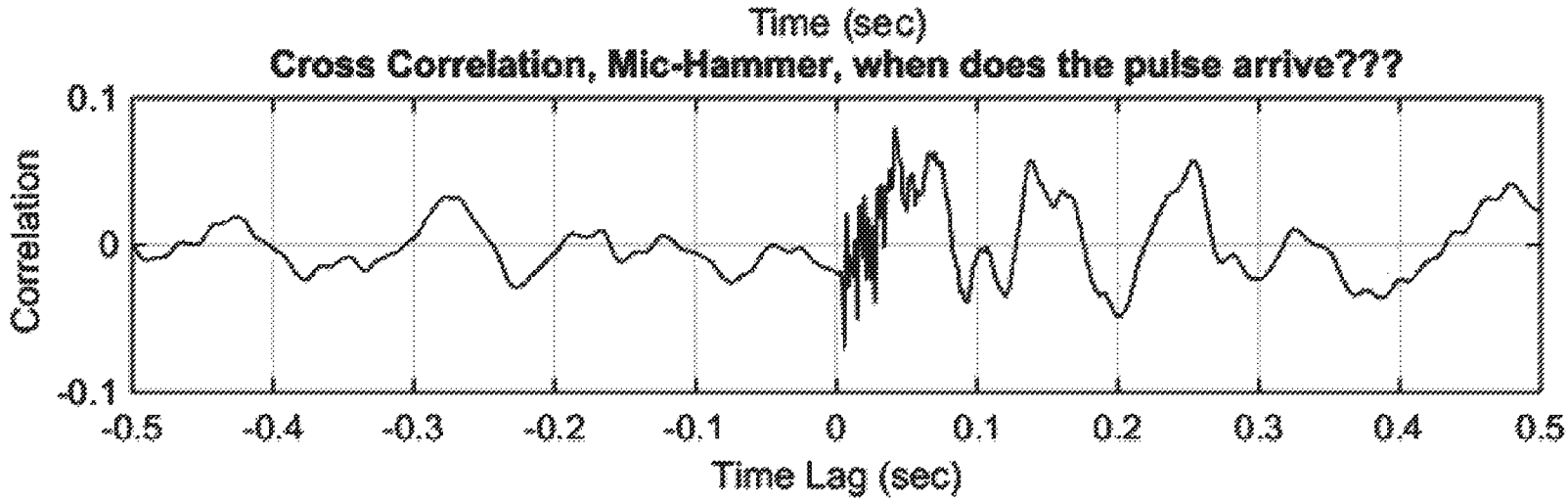
FIG. 9 illustrates an example chart showing the cross-correlation of microphone data and hammer data.

At block 220, the controller 105 may cross-correlate the microphone data and the hammer data. As explained above, this cross-correlation may be done off-line from the ANC system 100 by another processor or controller. The peak at this cross-correlation function represents the arrival time at the microphone. An example chart showing the microphone data is shown in FIG. 8. An example chart showing the cross-correlation is shown in FIG. 9.

Figure 7:
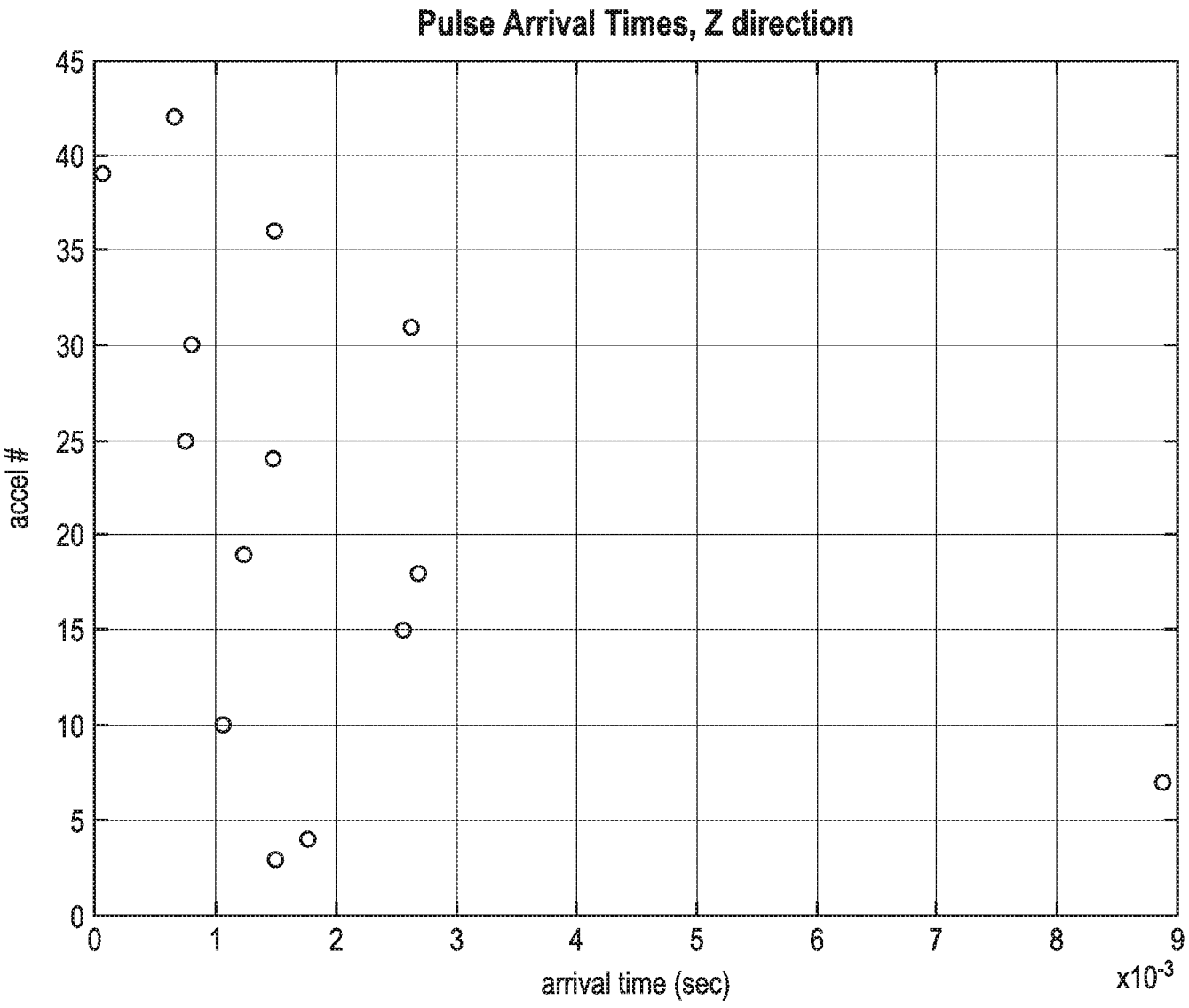
FIG. 7 illustrates an example plot of arrival times.

At block 225, the controller 105, or another controller separate from the ANC system 100, may plot the microphone arrival times versus the new acceleration data that identifies the propagation delay in block 210. This plotting may be done off-line from the ANC system 100. This plot may identify the propagation path as the vibration energy transfers through the structure toward the cabin. In practice, the arrival time of the last known structural point that is joined to the body should be a couple of msec before the microphone arrival times. That is, the pulse is followed through the structure to better identify the actual arrival of the pulse at the microphone. An example plot showing the arrival times are is shown in FIG. 7.

Figure 3:
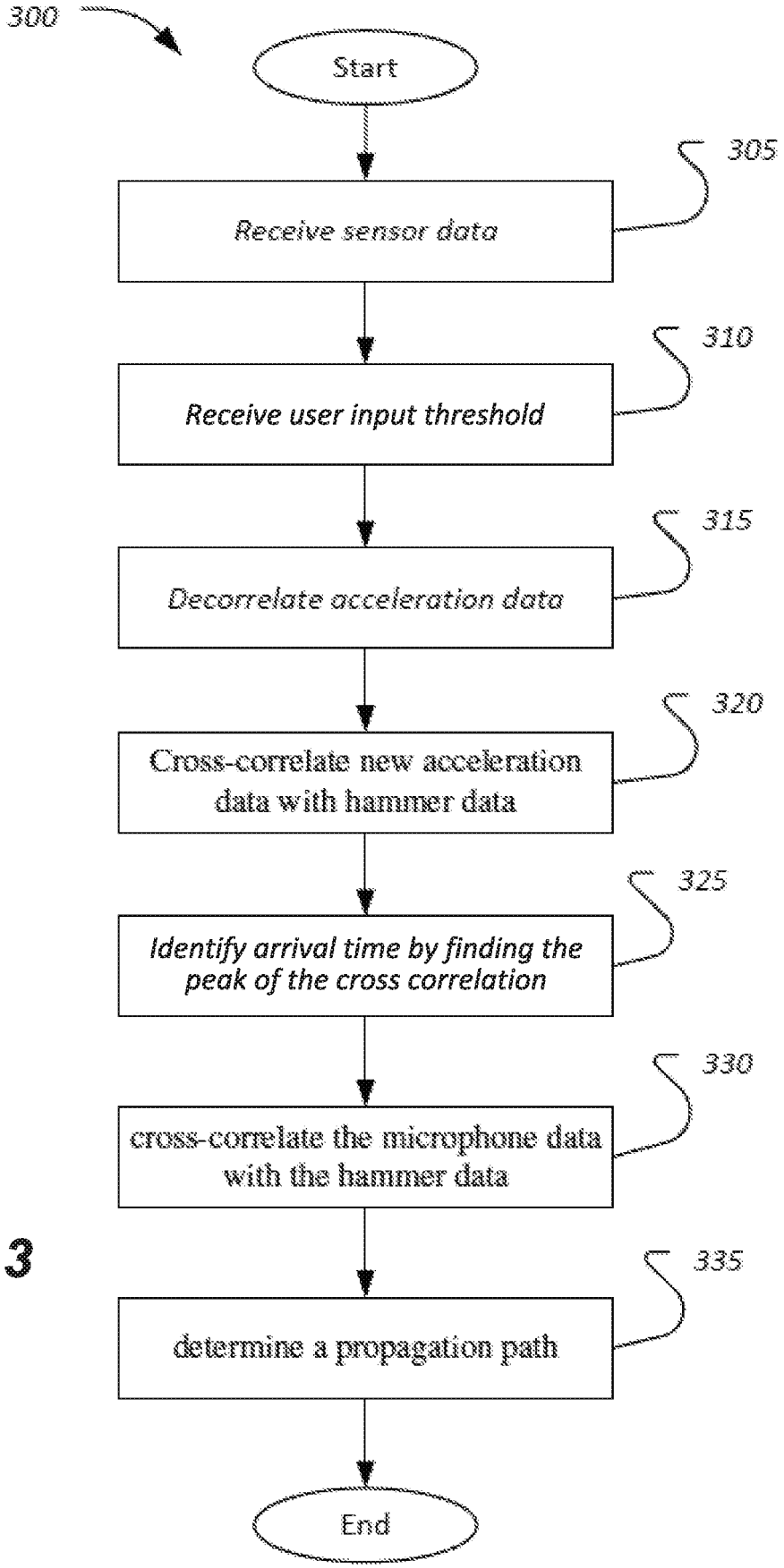
FIG. 3 illustrates an example process for the propagation delay identification system.

FIG. 3 illustrates an example flow chart for a process 300 of the propagation delay identification system 100. The controller 105 may be configured to perform the process 300, though a separate controller, processor, computing device, etc., may also be included to perform the process 300.

The process 300 may begin at block 300 where the controller may receive sensor data via from the input sensor 110. As explained above, the sensor data may include sensor data from the input signal received from the input sensor 110 indicative of an acceleration or motion. The sensor data may also include microphone data indicative of ambient noise.

At block 310, the controller 105 may receive additional data related to ARNC such as the hammer data.

At block 315, the controller 105 may decorrelate the acceleration data, similar to block 205 of FIG. 2.

At block 320, the controller 105 may cross-correlate the new acceleration data from block 315 with the hammer data received at block 310.

At block 325, the controller 105 may identify a peak of the cross-correlation by taking the absolute value of the cross-correlation of block 320.

At block 330, the controller 105 may cross-correlate the microphone data received at block 305 with the hammer data received at block 310, similar to block 220 of FIG. 2.

At block 335, the controller 105, or another controller separate from the ANC system 100, may determine a propagation path by plotting the cross-correlation of block 330 and the absolute value of block 325.

The process may then end.

FIG. 4 illustrates an example chart showing the acceleration data.

Figure 5:
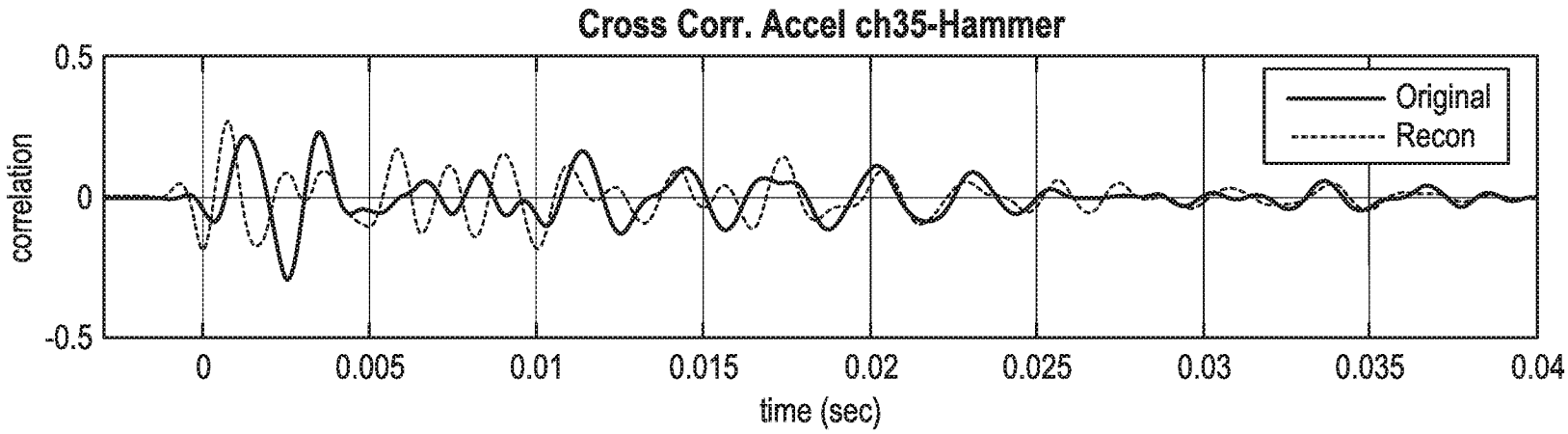
FIG. 5 illustrates an example chart showing the cross-correlation of new acceleration data and hammer data.

FIG. 5 illustrates an example chart showing the cross-correlation of new acceleration data and hammer data.

FIG. 6 illustrates an example chart showing the absolute value of the cross-correlation of FIG. 5.

FIG. 7 illustrates an example plot of arrival times.

FIG. 8 illustrates an example chart showing microphone data.

FIG. 9 illustrates an example chart showing the cross-correlation of microphone data and hammer data. The cross-correlation aids in identifying the arrival time of the pulse correctly While road noise and structural noise are described herein, the propagation delay identification system may also be applied to engine harmonic cancellation, airborne noises, aeroacoustics, fan, component level noise, etc. Furthermore, the system, while described with respect to a vehicle, may also be applicable to other situations, products and scenarios such as aerospace and civil engineering fields. These systems could be applied in manufacturing to identify defects in components, including buildings, materials, and electronics.

As explained herein, impulse response (IR) measurements are commonly used when trying to characterize an audio system in an environment. Standard practice in audio tuning is to first, time align speakers based on the first arriving energy based on the observed IR. Active noise control (ANC) applications also use IR measurements to store the secondary path information in the commonly used FxLMS algorithm. However, for ARNC systems, causality may be a concern. More specifically, the vibroacoustic energy coming along the primary path may arrive after the acoustic energy coming from the secondary path. If the causality criteria is met, then cancellation should be achievable.

If the causality criteria fails, the anti-noise signals provided by the speakers may be "late." Late anti-noise signals may lead to no, or very little, cancellation being achieved. However, different frequencies arrive at different times, both in the primary path and the secondary path.

As described above, the primary path propagation delay may be identified per frequency. The secondary path propagation delay may be identified per frequency, per speaker, and per microphone based on the IR measurements.

Historically, phase delay is one way of interpreting frequency dependent delay. However, phase delay may be better suited for pure DSP and telecommunications processes. Phase delay does not physically represent the frequency based electroacoustic delay encountered in IR measurements. Phase delay may be informative or relative information such as one measurement relative to another. Phase delay does not provide an absolute delay as this method herein describes.

Phase delay may be represented by:

$$\text{phase delay } (w) = \frac{-\theta}{w} \quad \begin{array}{l} \text{<- Unwrapped phase (radians)} \\ \text{<- Frequency (radians)} \end{array}$$

The secondary path propagation delay system and methods described herein allow causality to be realized. The secondary path may inhibit or enable performance on a frequency basis. This frequency based performance may facilitate complete understanding about performance limitations and audio architectures. The system may optimize RNC performance. In addition to RNC, this system may be applicable for other cancellation algorithms that require optimized speaker locations with minimal secondary path delay.

Figure 10:
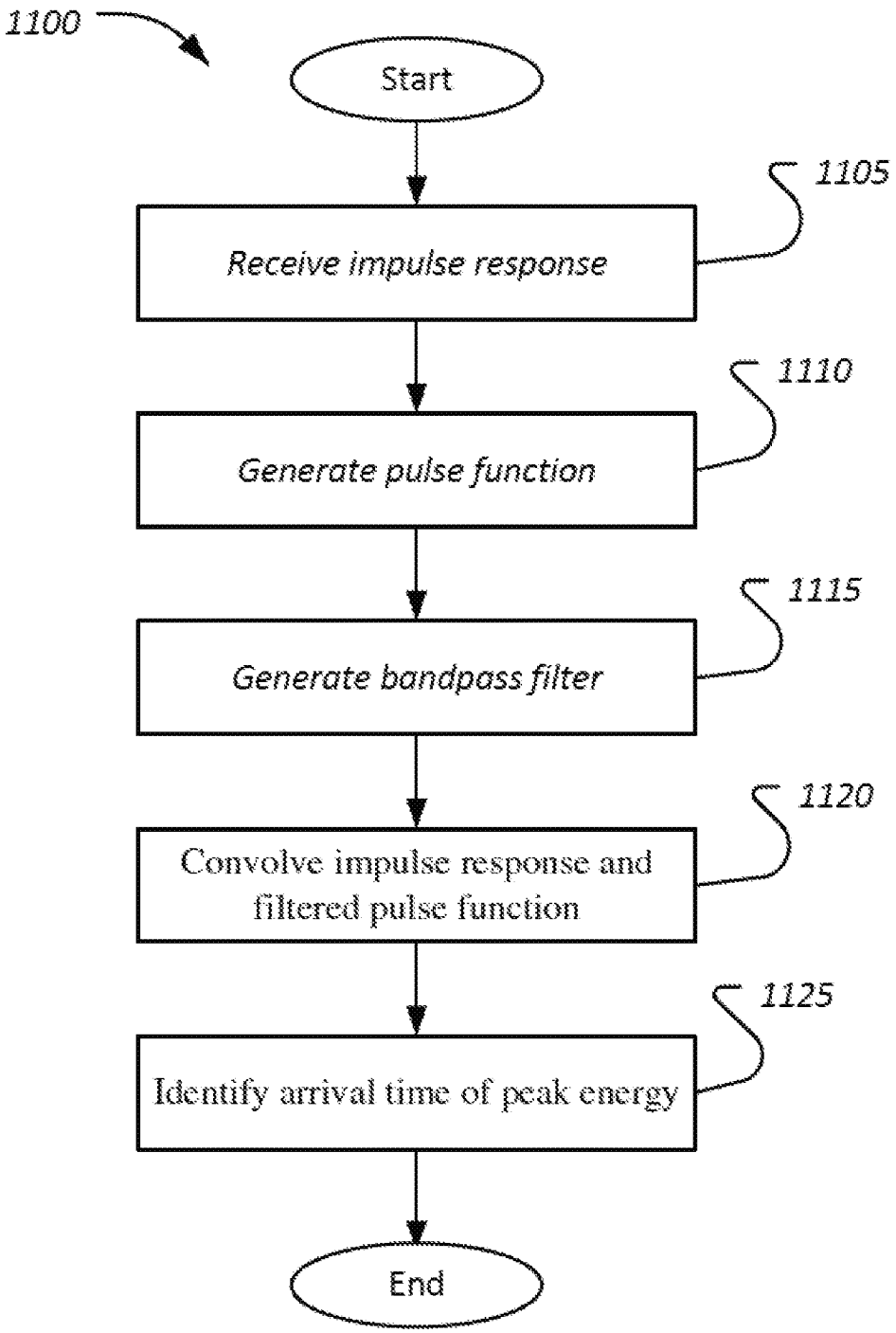
FIG. 10 illustrates an example secondary path propagation delay identification system in accordance with one embodiment.

FIG. 10 illustrates an example process flow 1100 for determining the secondary path propagation delay. The controller 105 may be configured to perform the process 1100, though a separate controller, processor, computing device, etc., may also be included to perform the process 100.

The process 1100 may begin at block 1105 where the controller 105 may receive the impulse response via the output sensors 145.

At block 1110, the controller 105 may generate a source pulse function. The source pulse may be completely separate from the impulse response. The IR may function as an audio system transfer function that is convolved with the IR. The pulse function may be generated based on any number of mechanisms. In one example, a pure dirac impulse with broad spectral energy and an infinitely small duration may be used. Ideally, a tunable pulse function may be used in order to allow for change in the pulse width and spectral content. A sine or cosine chip may be used.

Preferably, a function of time including two sigmoid functions having tunable parameters may be used to make up the pulse function. The r and delta parameters may control the pulse function and may be used to change the time duration and spectral content. For example, to examine low frequency content, the bandpass filter may not be set as to as high of an order because the source pulse originally does not contain as much high frequency content. This may create a more front-end approach to generating a clean pulse. The pulse width may be less than the period of the first arriving frequency of interesting and the spectral content has decreasing energy at higher frequencies. The pulse function may be represented below:

$$I(t) = \left(\frac{1}{1+e^{-rt}}\right)\left(\frac{1}{1+e^{r(t-\delta)}}\right)$$

At block 1115, the controller 105 may generate a bandpass filter. The bandpass filter may filter the pulse function down to a certain frequency range. The sideband attenuation, as well as the passband and stopband frequencies may be altered so that the filter is of minimal order. Once the pulse function is filtered, the pulse function may be equalized so that the narrowband content has the same energy as that of the original broadband content. This aids to improve the signal to noise ratio.

The filtering process involves forward and reverse filtering of the pulse function to ensure zero or near-zero phase and magnitude distortion.

Figure 11:
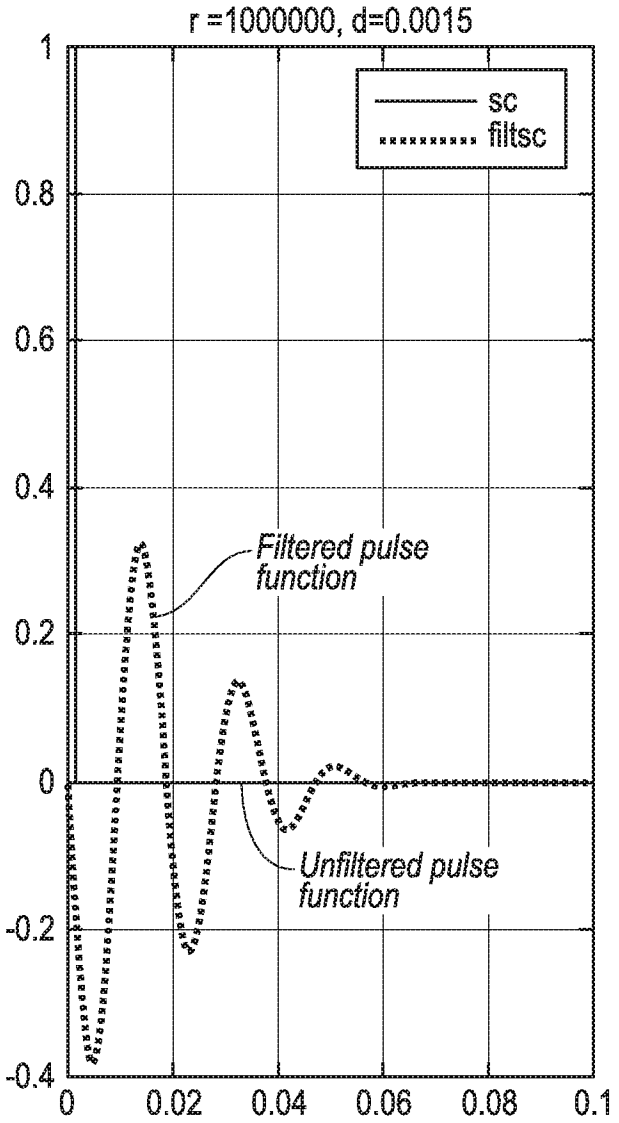
FIG. 11 illustrates an example of the source and filtered pulse signals in the domain.

FIG. 11 illustrates an example graph of the unfiltered pulse function and the filtered pulse function.

Figure 12:
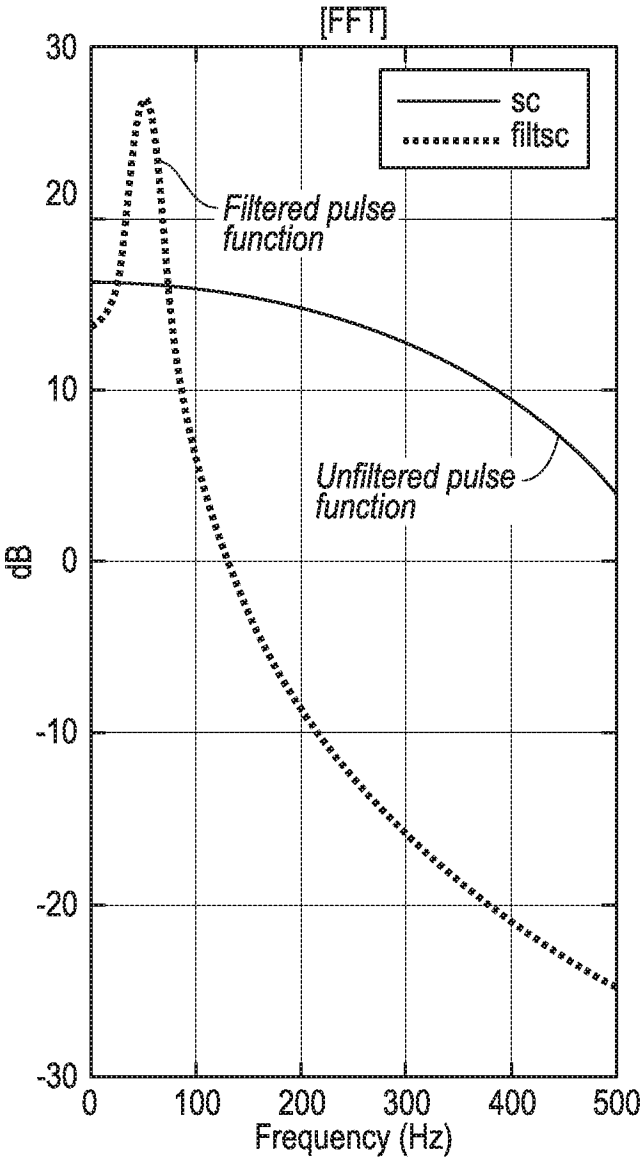
FIG. 12 illustrates an example of the source and filtered pulse signals in the frequency domain.

FIG. 12 illustrates a graph of the matching spectral content of the unfiltered pulse function and the filtered source pulse.

Figure 13:
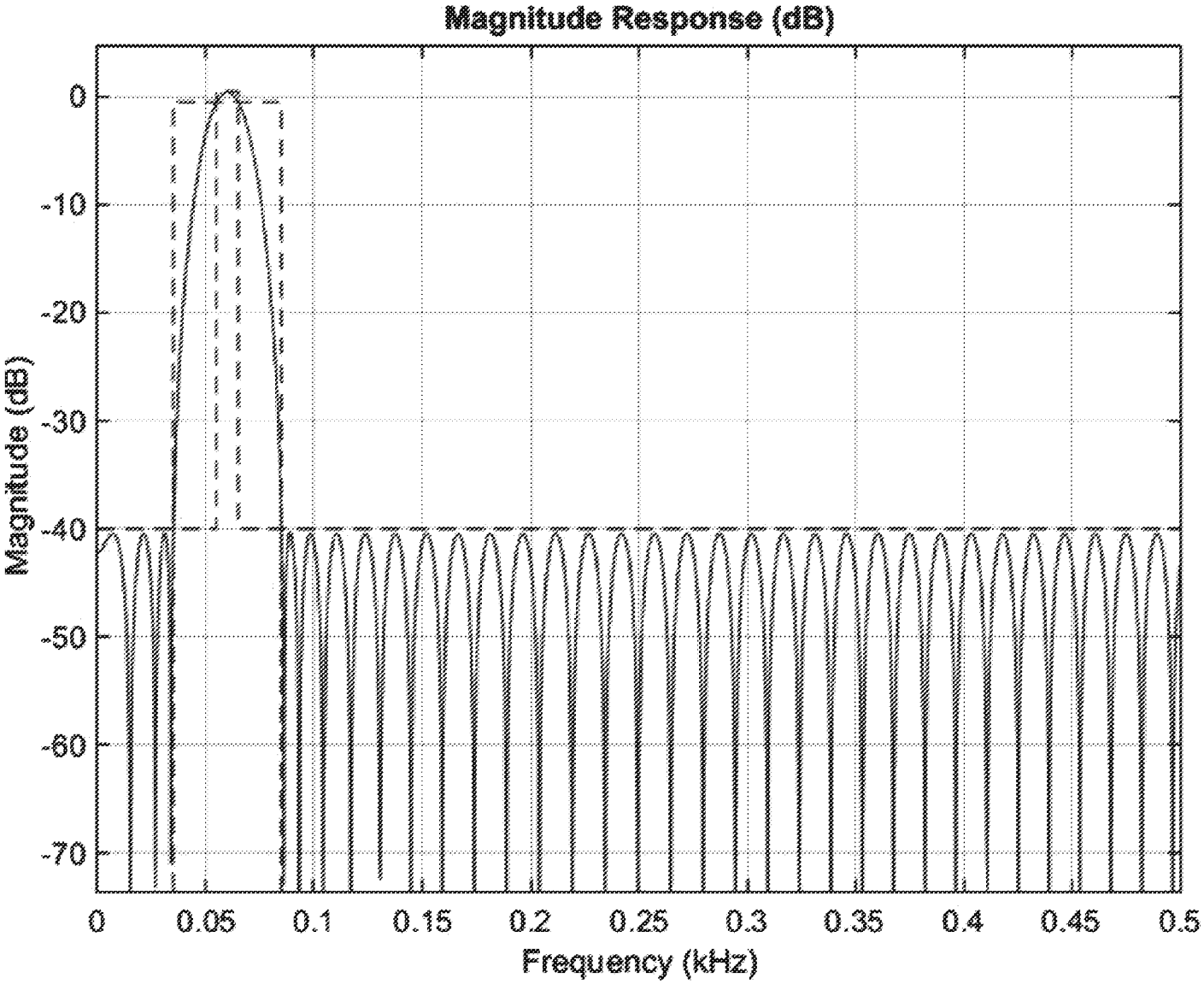
FIG. 13 illustrates an example graph of the frequency response of the bandpass filter.

FIG. 13 illustrates an example graph of the magnitude of a filtered pulse function and the entire unfiltered pulse function. The new pulse function may have multiple cycles with a decaying time envelope with no leading or ending transients. This ensures that when the pulse function is convolved with the impulse response itself, the only response observed will be due to the impulse response and not due to the filtered artifacts in the source signal.

Returning to FIG. 10, at block 1120, the controller 105 may convolve the impulse response with the filtered source signal.

Figure 14A:
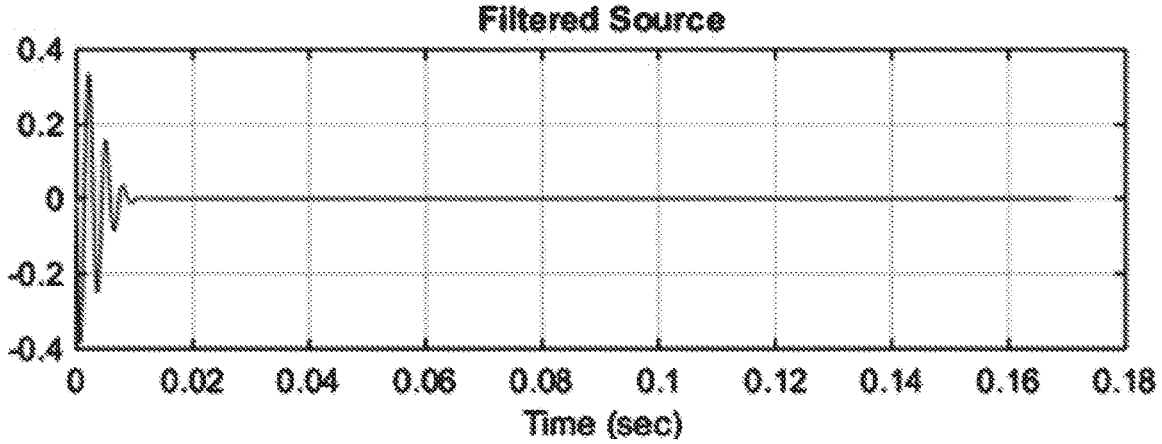
FIG. 14A illustrates an example graph of the filtered pulse source in the time domain.

FIG. 14A illustrates an example filtered pulse function.

Figure 14B:
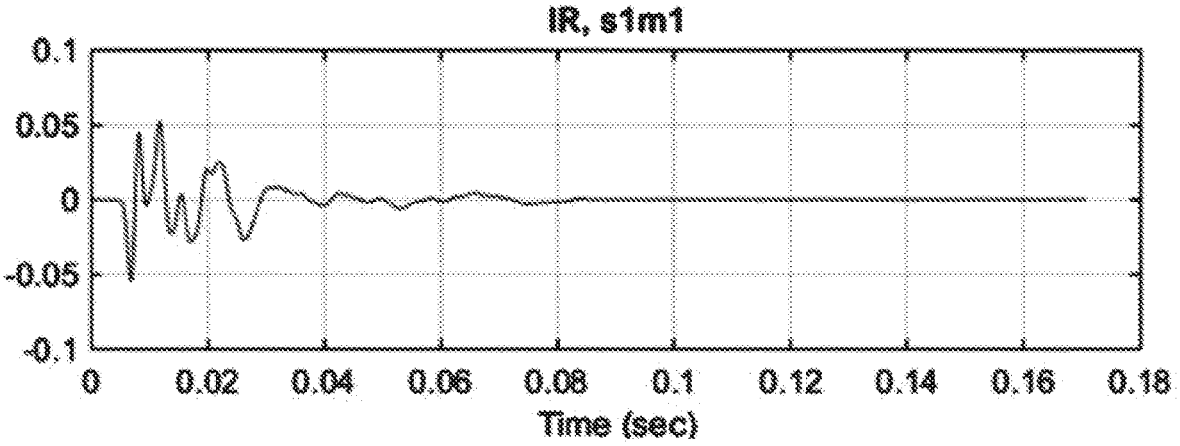
FIG. 14B illustrates an example graph of one secondary path.

FIG. 14B illustrates an example secondary path impulse response.

Figure 14C:
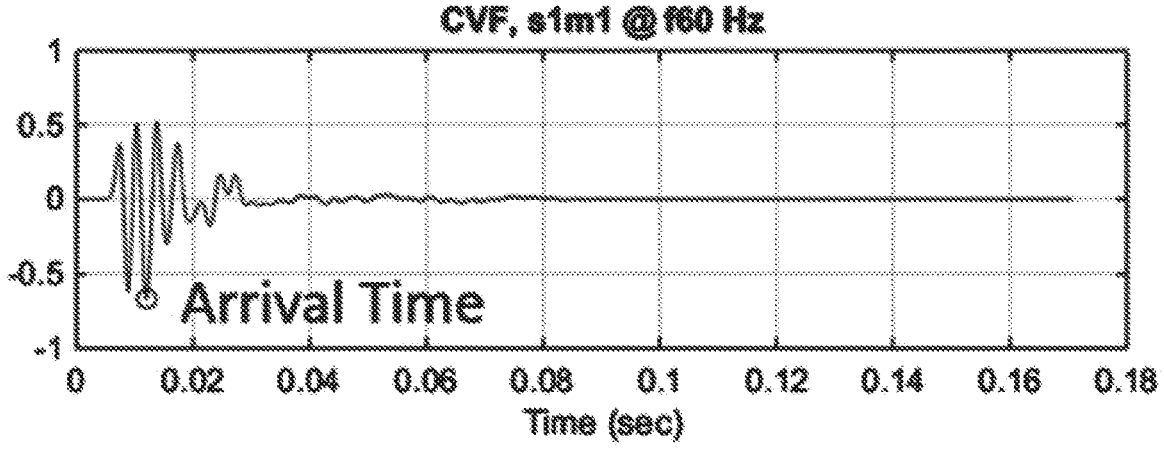
FIG. 14C illustrates an example graph of the filtered source pulse convolved with the secondary path.
Figure 15A:
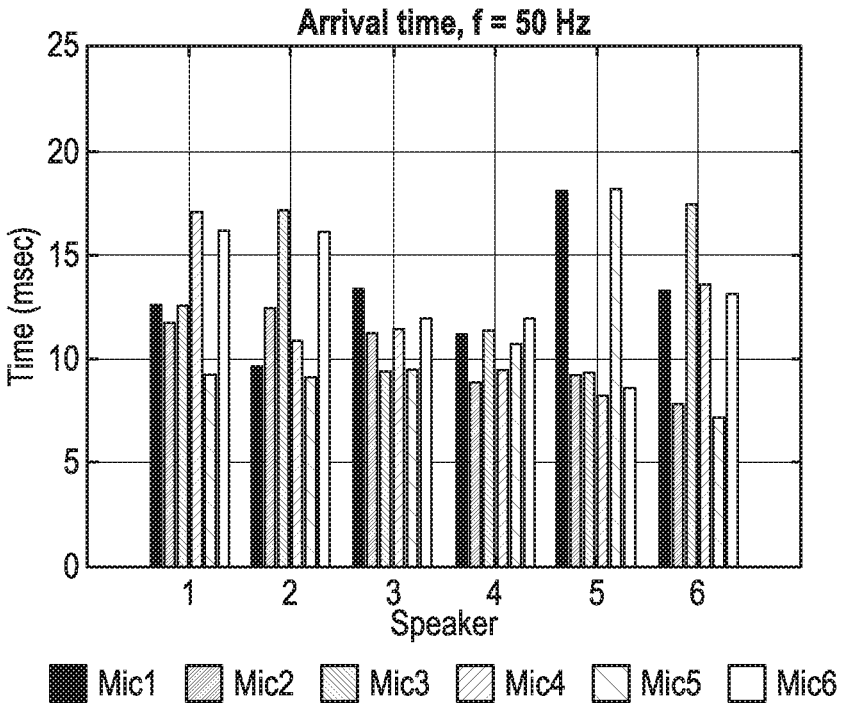
Figure 15B:
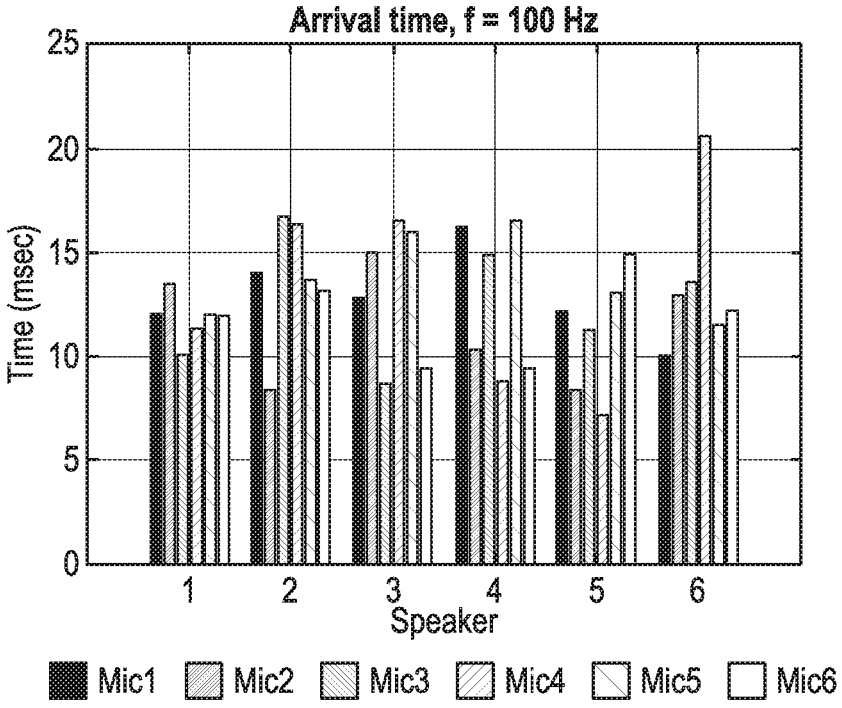
Figure 15E:
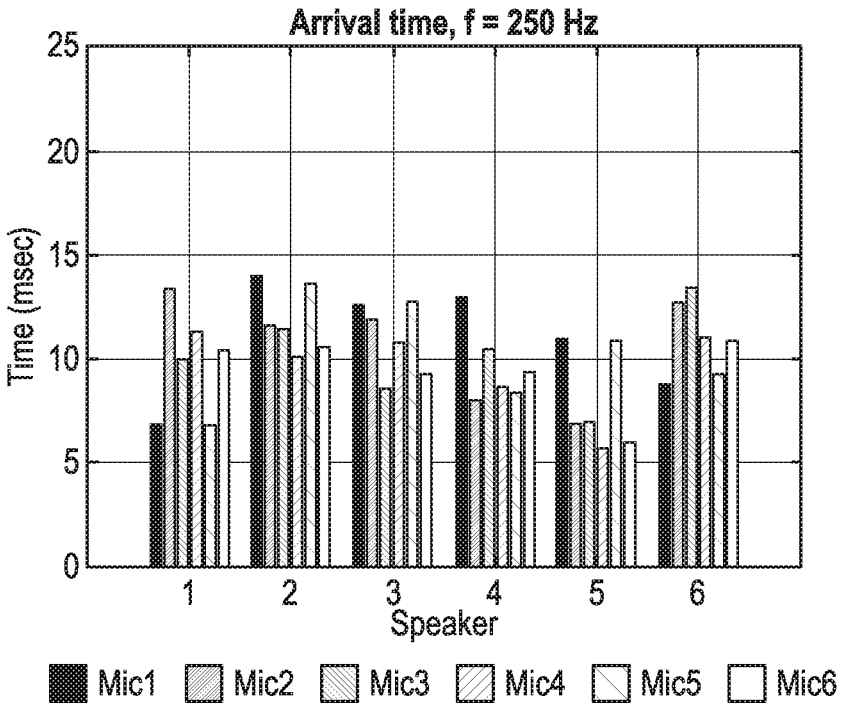
Figure 15F:
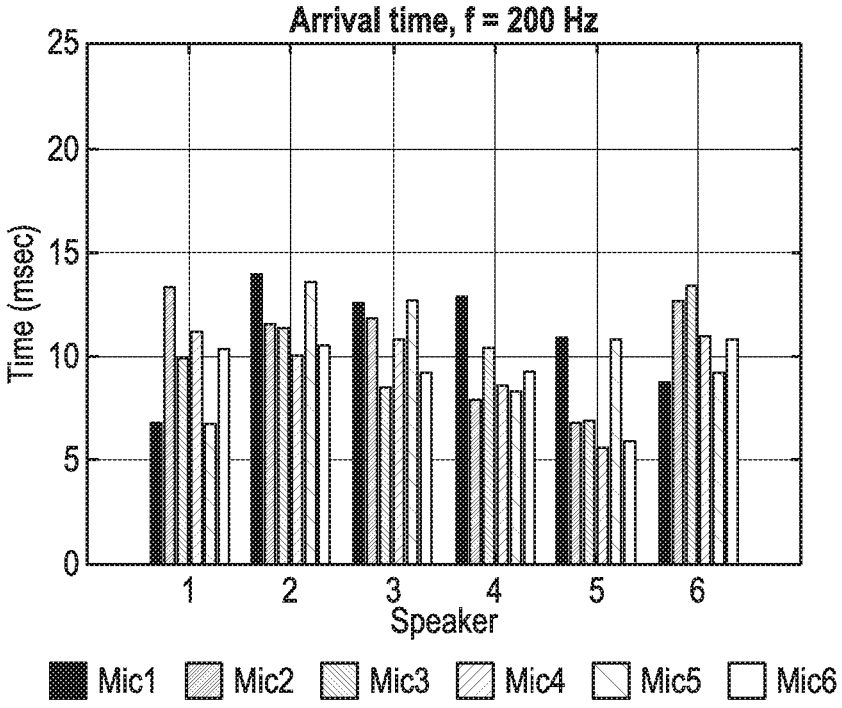

FIG. 14C illustrates an example convolved signal of the filtered pulse function and the impulse response.

Returning to FIG. 10, at block 1125, the controller 105 may identify the arrival time based on a peak energy of the convolved signal. Unlike the primary path propagation delay where the first arriving energy is determined as the arrival time, the secondary path propagation delay uses the peak energy as the arrival time. This is indicated in FIG. 14C.

The process then ends.

FIGS. 15A-F illustrate example results of arrival times for various speakers at various frequencies. In the example shown in FIG. 15A, a 50 Hz wave coming from the primary path arrives at the microphone at 10 ms. Speaker 1 to microphone 5 maintain causality, as shown in the graph. Speaker 1 may then provide cancelation to that microphone, but not to the other microphones.

The amount of noise cancelation is subject to other parameters. However, a speaker may provide cancelation to different microphones at different frequencies.

Figure 16A:
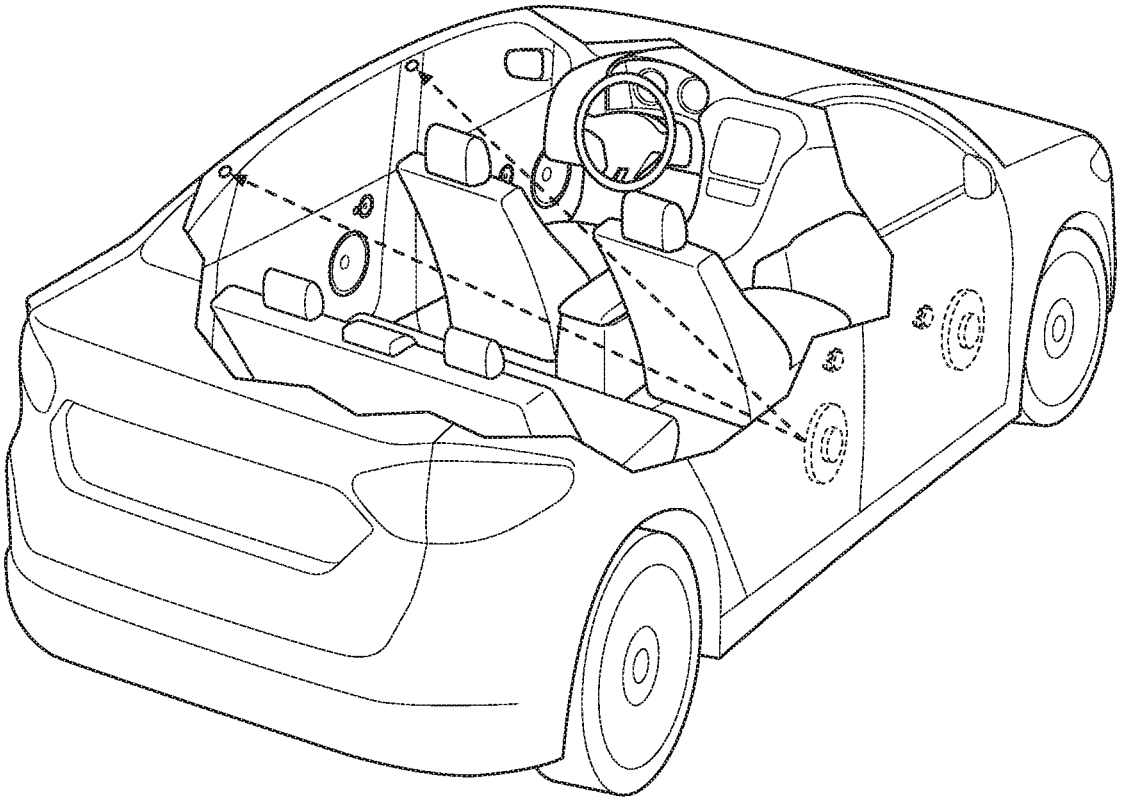
FIG. 16A illustrates an example vehicle with example microphone and speaker placement.

FIG. 16A illustrates an example vehicle with example microphone and speaker placement.

Figure 16B:
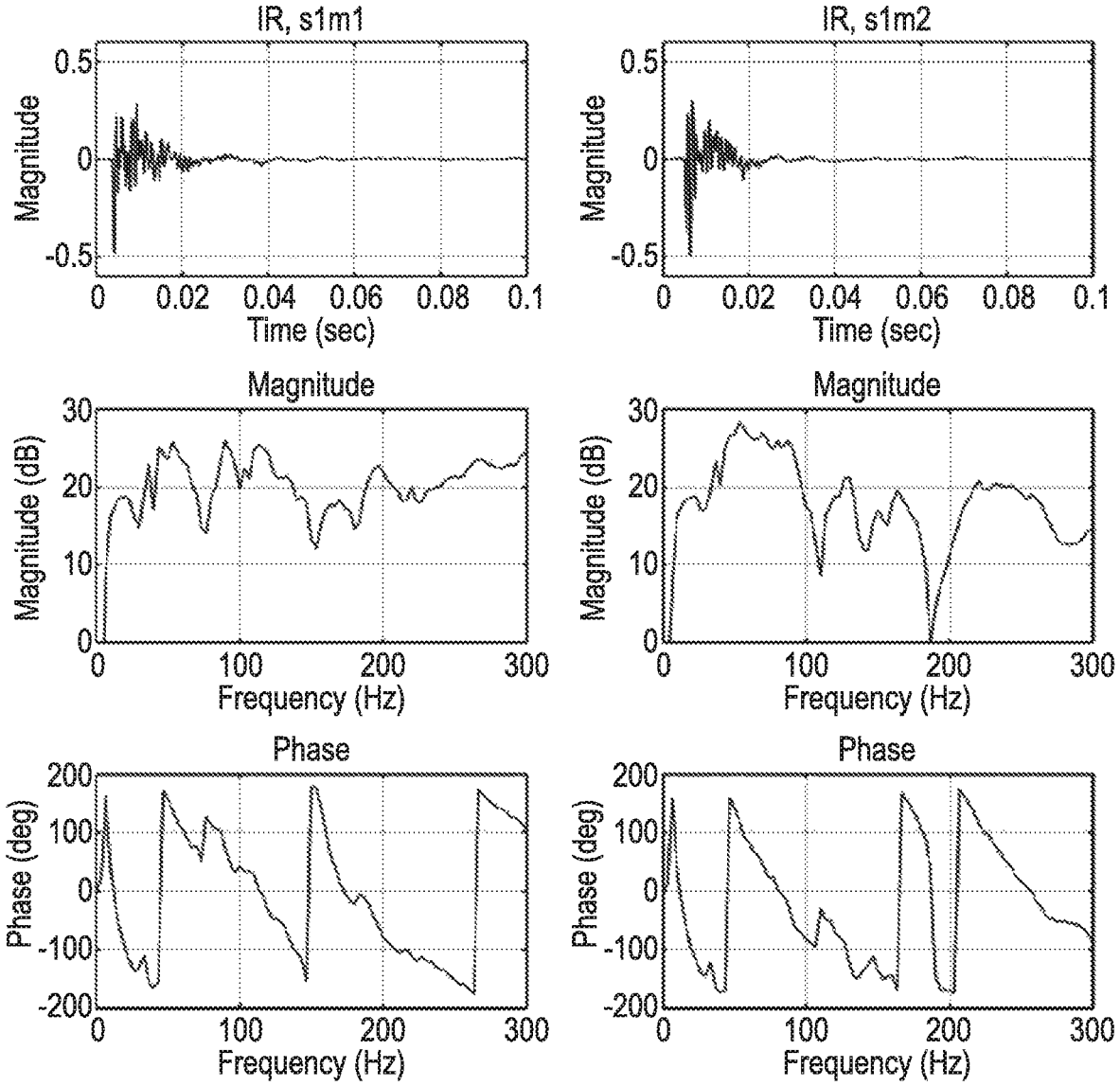
FIG. 16B illustrates an example impulse response, magnitude and phase for various components.

FIG. 16B illustrates example impulse response, magnitude and phase for various components.

Figure 17:
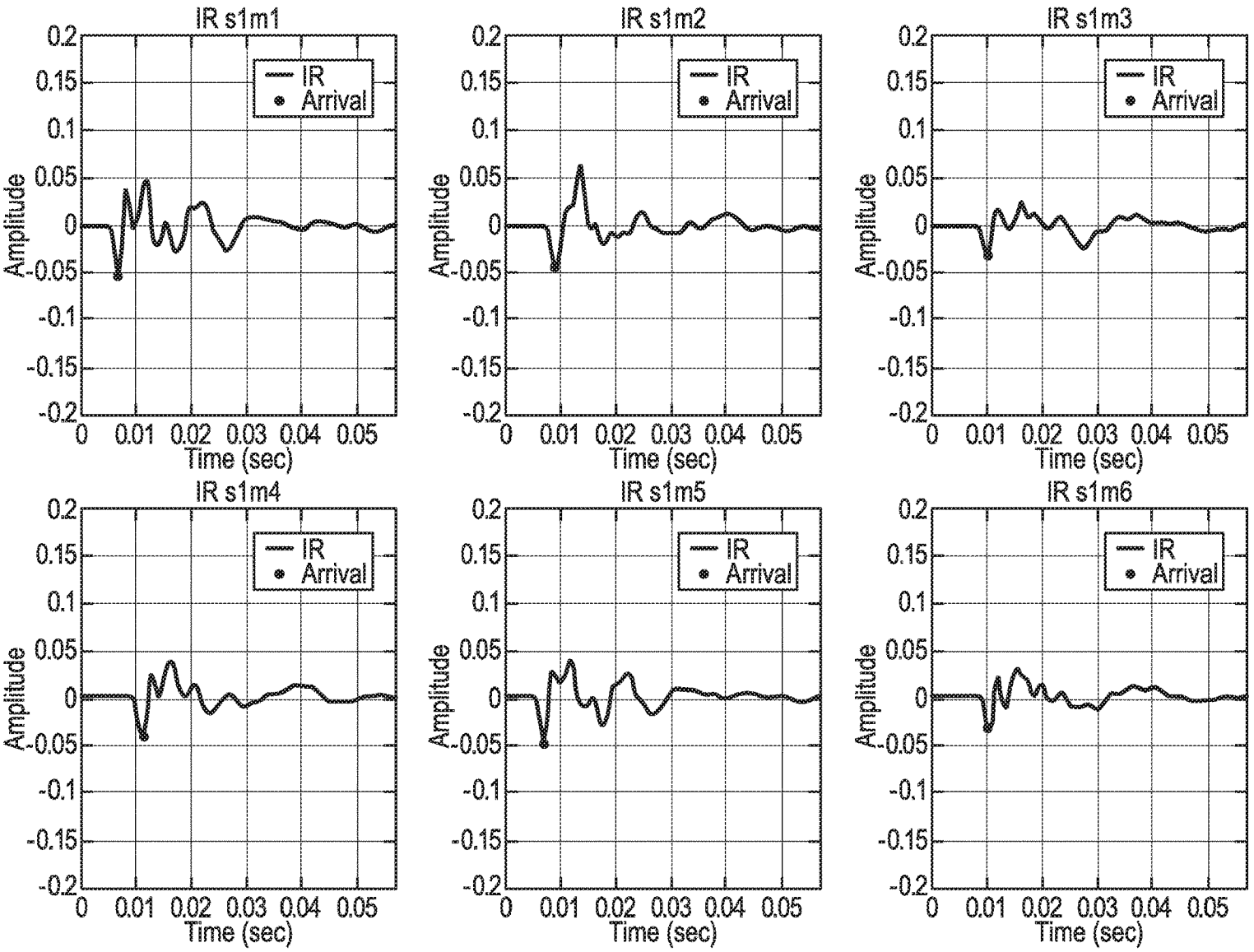
FIG. 17 illustrates an example of identified earliest arrival times for multiple secondary paths.

FIG. 17 illustrates example secondary path impulse responses and their earliest arriving energy.

The propagation delay identification system, both in the primary path and secondary path, may be applied to engine harmonic cancellation, airborne noises, aeroacoustics, fan, component level noise, etc. Furthermore, the system, while described with respect to a vehicle, may also be applicable to other situations, products and scenarios such as aerospace and civil engineering fields. These systems could be applied in manufacturing to identify defects in components, including buildings, materials, and electronics.

Figure 18:
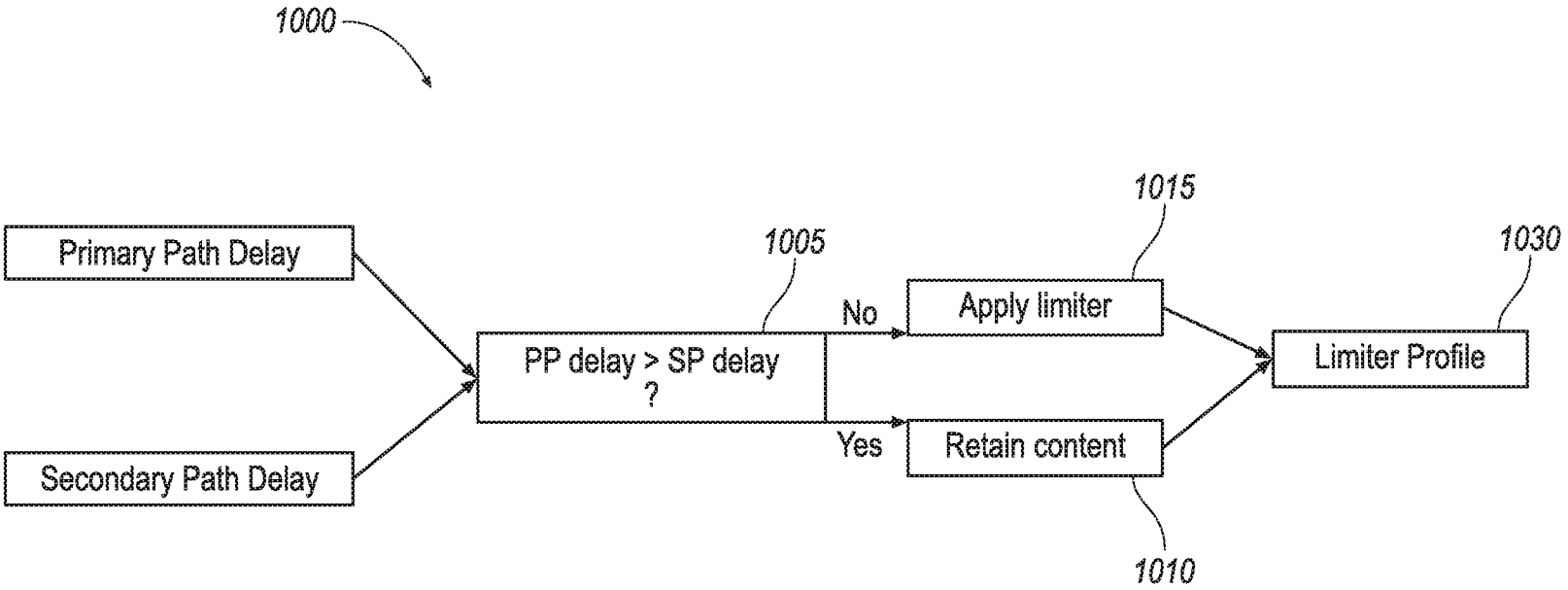
FIG. 18 illustrates an example process of the binary limiter generator.

FIG. 18 illustrates an example process 1000 of the binary limiter generator 150. While the binary limiter generator 150 is shown as a separate component from the controller 105, the controller 105 may perform the steps and features of the process 1000. Additionally or alternatively, the process 1000 may be performed by a separate controller or processor (not shown).

At block 1005, controller 105 may receive the primary path delay and the secondary path delays. The controller 105 may then determine whether the primary path delay exceeds the secondary path delay. If so, the process 1000 proceeds to block 1010. If not, the process 200 proceeds to block 1015. This block 1005 may determine whether causality is met.

At block 1010, the controller 105 may retain the frequency content of the reference/error signals.

At block 1015, the controller 105 may apply a limiter in response to the causality criteria not being met.

At block 1030, the controller 105 may set the limiter profile.

Figure 19:
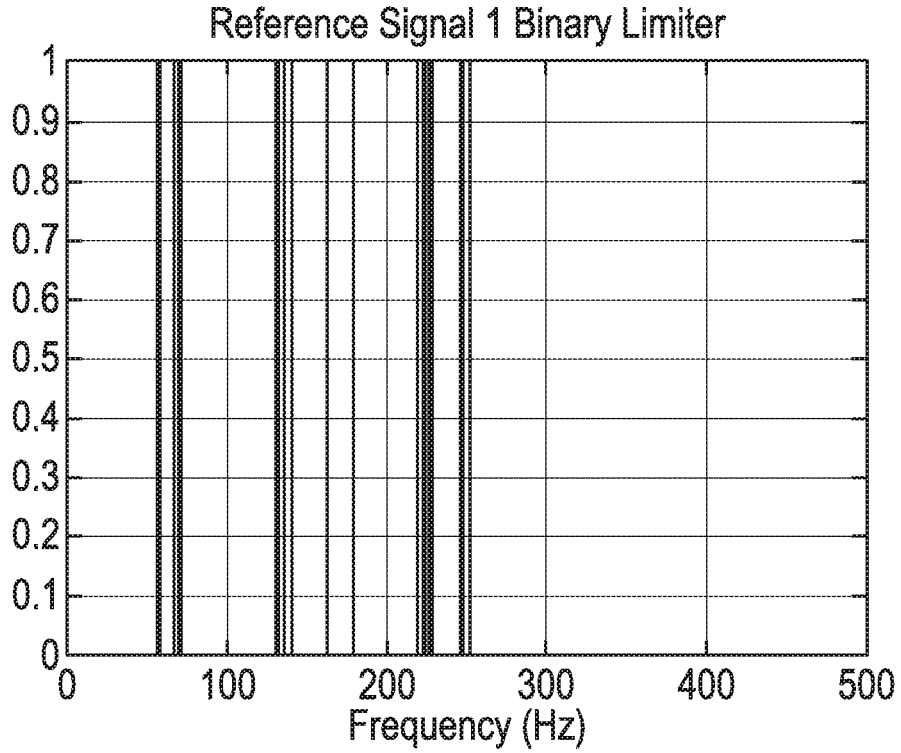
FIG. 19 illustrates an example graph of a binary limiter, set by frequency bin based on the causality test.

FIG. 19 illustrates an example graph of a binary limiter, set by frequency bin based on the causality test.

Figure 20:
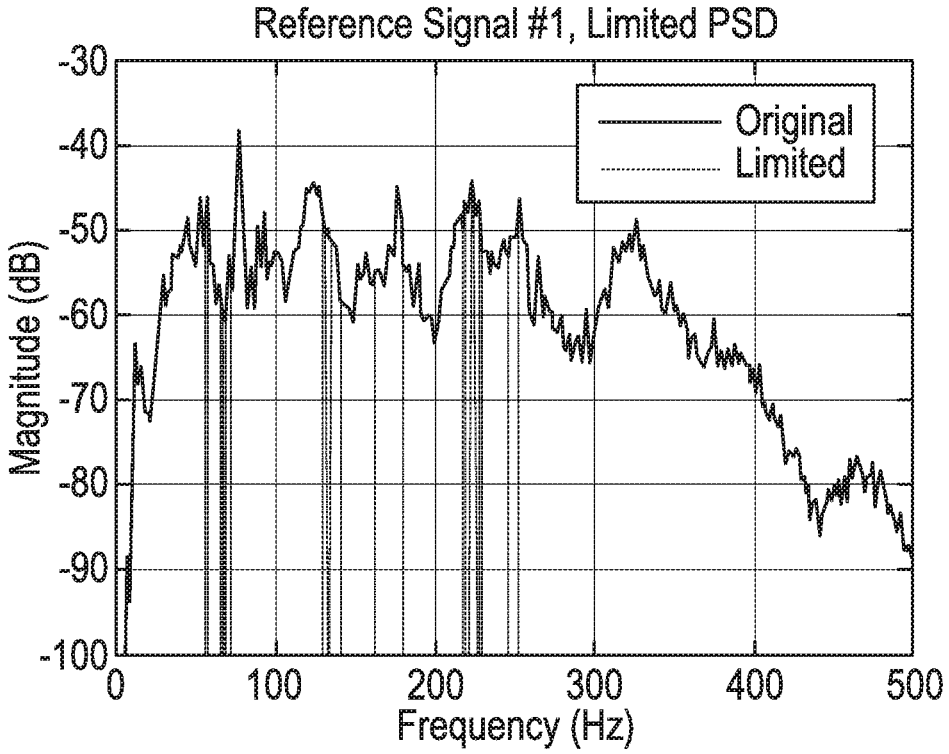
FIG. 20 illustrates an example graph of a binary limiter enacted on the frequency domain.

FIG. 20 illustrates an example graph of a binary limiter enacted on the frequency domain.

Figure 21:
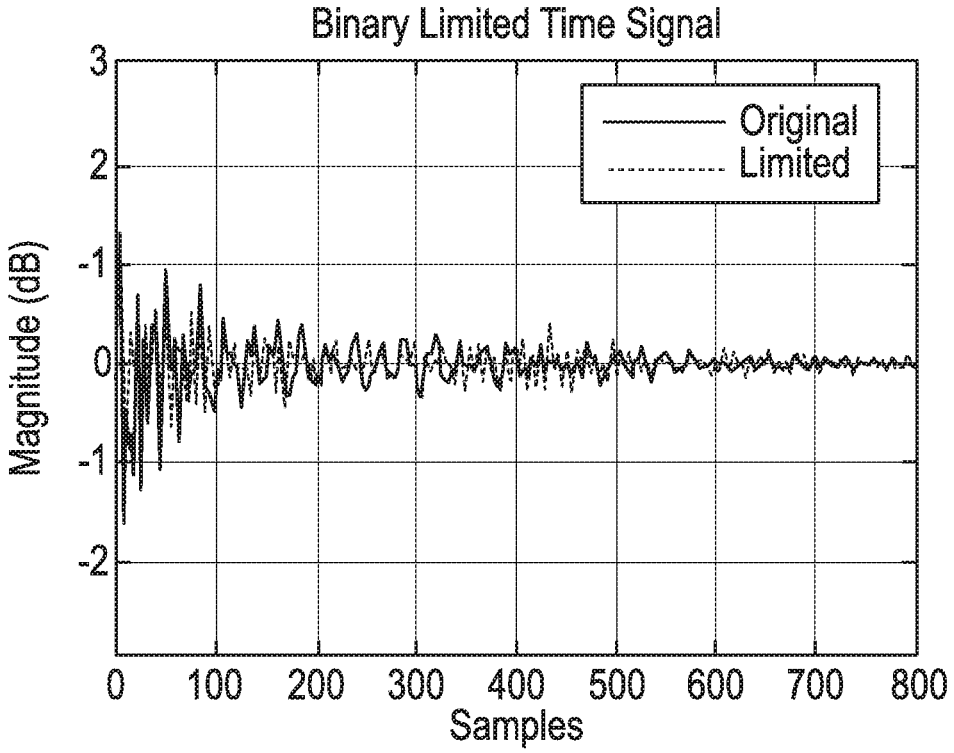
FIG. 21 illustrates a binary limited time signal.

FIG. 21 illustrates a binary limited time signal. Note that the binary limiter is applied in the frequency domain where each of the delays are assessed per frequency bin.

Figure 22:
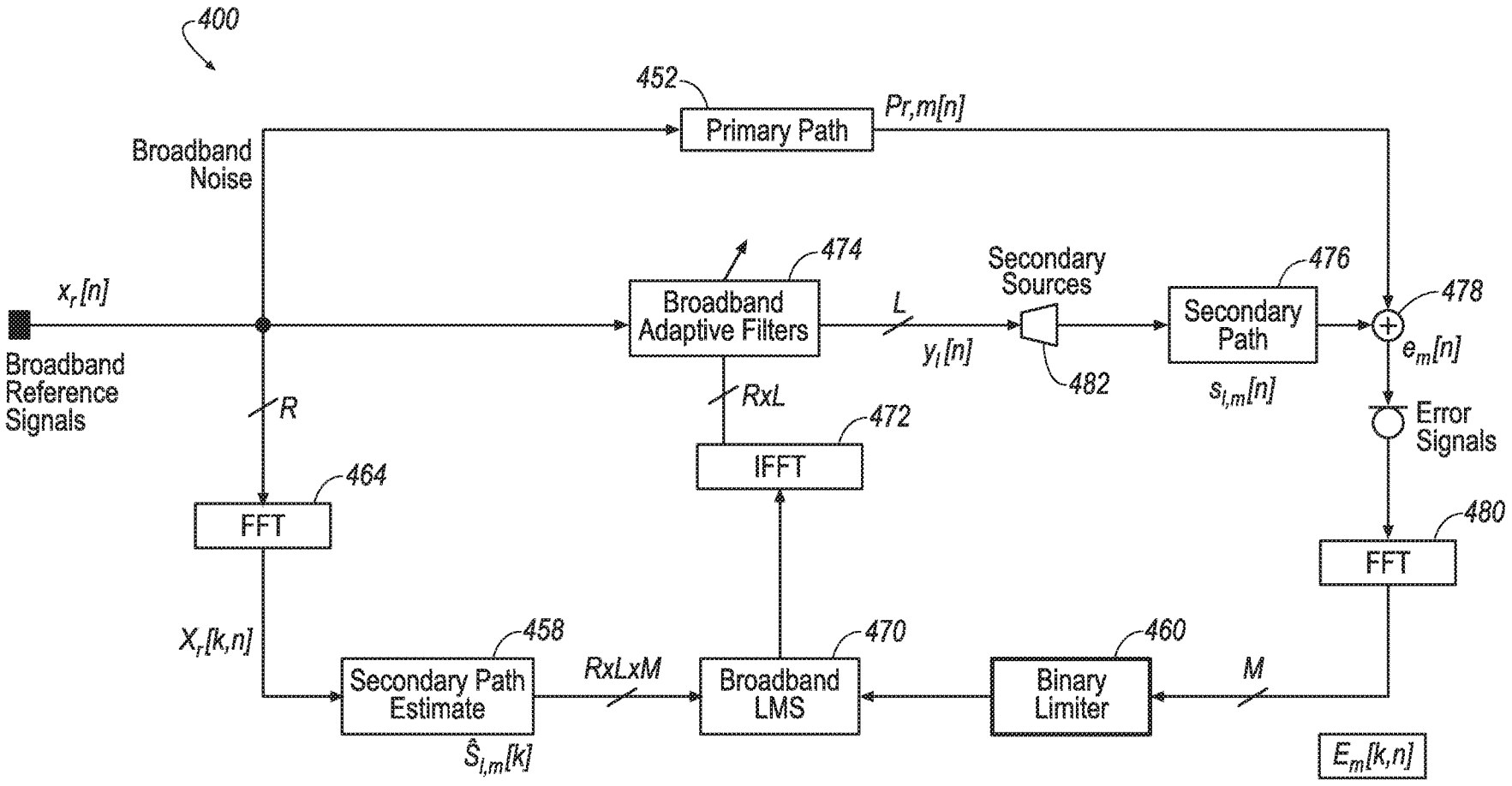
FIG. 22 illustrates another version of an example ANC system with filtering being applied to the error signal.
Figure 23:
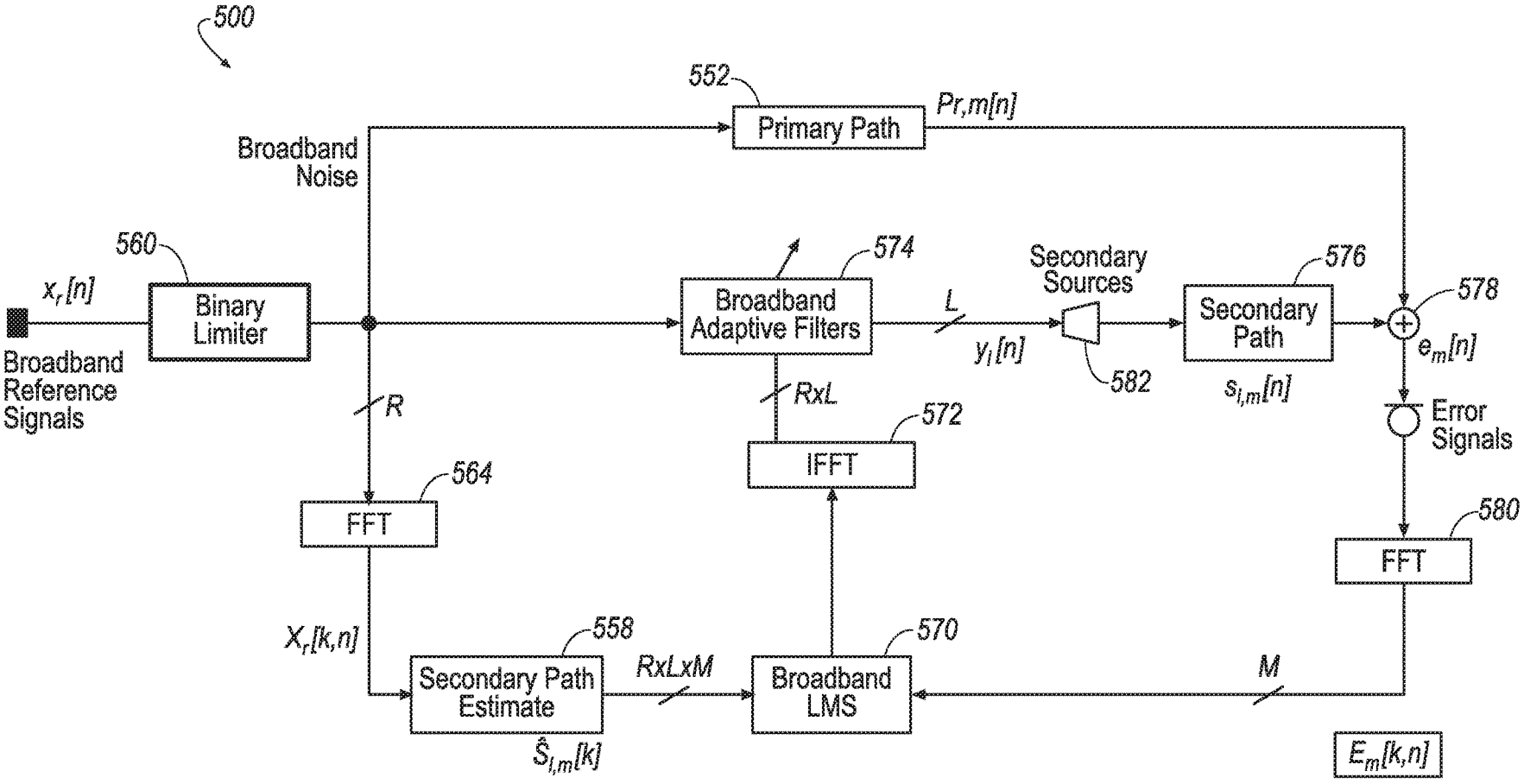
FIG. 23 illustrates another version of an example ANC system with filtering and limiting being applied to the reference signals in the time domain.
Figure 24:
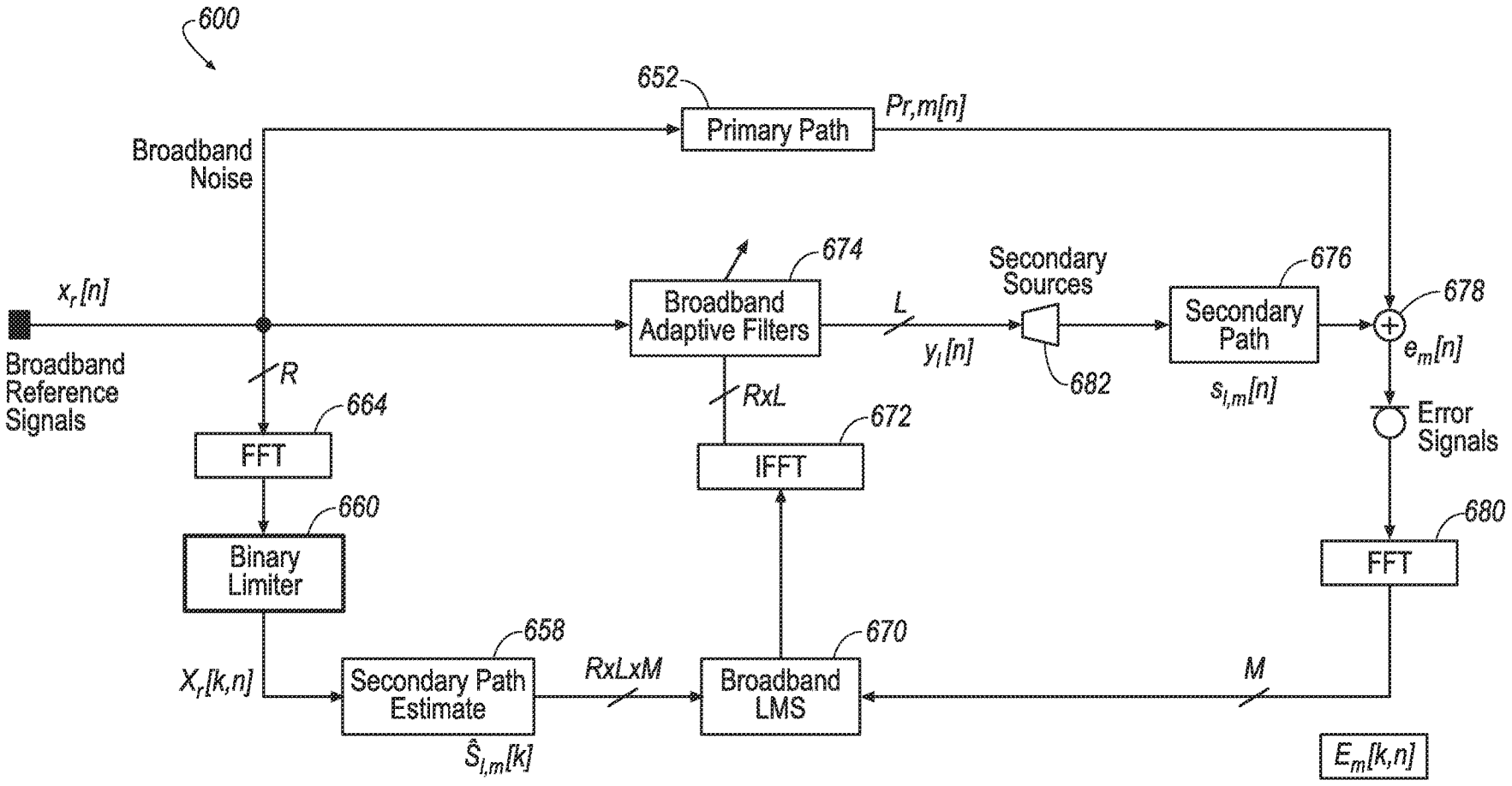
FIG. 24 illustrates another version of an example ANC system with limiting of the reference signals in the frequency domain.

FIGS. 22-24 illustrate example schematics of the ANC system 100 having the binary limiter 460, 560, 660. The variables and other symbols labeled in the schematics are as follows:

| Item | Symbol | Definition |
|---|---|---|
| 1 | [n] | sample in the time domain |
| 2 | [k] | bin in the frequency domain |
| 3 | R | total dimensional number of reference signals |
| 4 | L | total dimensional number of secondary sources |
| 5 | M | total dimensional number of error signals |
| 6 | r | Individual reference signal, r = 1 . . . R |
| 7 | l | Individual secondary source, l = 1 . . . L |
| 8 | m | Individual error signal, m = 1 . . . M |
| 9 | $x_r[n]$ | reference signals in the time domain Broadband: $x_{r\sim bb}[n]$ Narrowhand: $x_{r\sim nb}[n]$ |
| 10 | $\hat{x}_r[n]$ | Reference signal in the time domain with filtering applied |
| 11 | $X_r[k, n]$ | time dependent reference signals in the frequency domain |
| 12 | $\hat{S}_{l,m}[k]$ | estimated secondary paths in the frequency domain, LxM matrix |
| 13 | $\hat{s}_{l,m}[k]$ | Estimated secondary paths in the time domain, LxM matrix |
| 14 | $s_{l,m}[n]$ | secondary path in the time domain, LxM matrix |
| 15 | $P_{r,m}[n]$ | time dependent primary propagation paths in the frequency domain, RxM matrix |
| 16 | $y_l[n]$ | secondary source signal |
| 17 | $e_m[n]$ | error signal in the time domain |
| 18 | $E_m[k, n]$ | time dependent error signals in the frequency domain |

FIG. 22 illustrates a version of an example ANC system 400 with filtering being applied to the error signal. The system 400 may include a primary path 452 supplying a time dependent primary propagation path $P_{r,m}[n]$. In one example, the propagation path $P_{r,m}[n]$ may be acquired by one or more speed sensors configured to detect rotation of shafts of the engine fan or other RPM related noise. Additionally or alternatively, the propagation path $P_{r,m}[n]$ may be acquired by the microphone, accelerometer, sound intensity sensor, etc.

The system 400 may receive at least one broadband reference signal $x_r[n]$. The broadband reference signal $x_r[n]$ may be supplied to a broadband adaptive filter 474. The broadband adaptive filter 474 may filter the broadband reference signal $x_r[n]$ and generate a broadband secondary signal $y_l[n]$.

The broadband reference signal $x_r[n]$ may be provided to a Fast Fourier Transform block 464. An FFT may be applied to the broadband reference signal $x_r[n]$ to provide a time dependent reference signal $X_r[k,n]$ in the frequency domain to the secondary path estimate block 458.

The secondary path estimate block 458 may estimate a secondary path for each the time domain and the frequency domain and determine an estimated secondary path in the frequency domain $\hat{S}_{l,m}[k]$ and an estimated secondary path in the time domain $\hat{s}_{l,m}[k]$. The secondary path estimate block 158 may provide a R×L×M matrix to a broadband least mean squared block 470, where:

R is the total dimensional number of reference signals,

L is the total dimensional number of secondary sources, and

M is the total dimensional number of error signals.

The broadband least mean square (LMS) block 470 may be configured to update the adaptive filter coefficients. An inverse FFT may then be applied to this signal at the IFFT bock 472. An R×L matrix may then be supplied to a broadband adaptive filter 474.

The broadband adaptive filter 474 may supply the broadband secondary source signal $y_l[n]$ to a secondary source 482. The secondary source signal $y_l[n]$ may then be passed to a secondary path 476. The secondary path 476 represents the transfer function of the acoustic system (speakers, microphones, and interior vehicle acoustics).

At summation 478, the secondary path antinoise signals 476 and primary path noise signals 452 are summed, resulting in an error signal $e_m[n]$. The error signal $e_m[n]$ may be acquired from the input sensors 110 such as a microphone. The summed signal may be input into a Fast Fourier Transform 480 forming an estimated error signal $E_m[k,n]$.

The binary limiter 460 as generated by the binary limiter generator 150 of FIGS. 1 and 2, may then be applied to the estimated error signal $E_m[k,n]$.

FIG. 23 illustrates another version of an example ANC system 500 with filtering and limiting being applied to the reference signals in the time domain.

The system 500 may include a primary path 552 supplying a time dependent primary propagation path $P_{r,m}[n]$. The system 500 may receive at least one broadband reference signal $x_r[n]$. The broadband reference signal $x_r[n]$ may be supplied to a binary limiter 560. The binary limiter 560 may provide a filtered reference signal $\hat{x}_r[n]$ in the time domain. The filtered reference signal $\hat{x}_r[n]$ may be provided to a broadband adaptive filter 574. The broadband adaptive filter 574 may filter the broadband reference signal $x_{rb}[n]$ and generate a broadband secondary signal $y_l[n]$.

The broadband reference signal $x_r[n]$ may be provided to a Fast Fourier Transform block 564. An FFT may be applied to the broadband reference signal $x_r[n]$ to provide a time dependent reference signal $X_r[k,n]$ in the frequency domain to the secondary path estimate block 558.

The secondary path estimate block 558 may estimate a secondary path for each the time domain and the frequency domain and determine an estimated secondary path in the frequency domain $\hat{S}_{l,m}[k]$ and an estimated secondary path in the time domain $\hat{s}_{l,m}[k]$. The secondary path estimate block 558 may provide a R×L×M matrix to a broadband least mean squared block 570. where:

The broadband least mean square (LMS) block 570 may be configured to update the adaptive filter coefficients. An inverse FFT may then be applied to this signal at the IFFT bock 572. An R×L matrix may then be supplied to a broadband adaptive filter 574.

The broadband adaptive filter 574 may supply the broadband secondary source signal $y_l[n]$ to a secondary source 582. The secondary source signal $y_l[n]$ may then be passed to a secondary path 576.

At summation 578, the secondary path 576 and primary path 552 are summed, resulting in an error signal $e_m[n]$. The summed signal may be input into a Fast Fourier Transform 580 forming an estimated error signal $E_m[k,n]$.

FIG. 24 illustrates another version of an example ANC system 600 with limiting of the reference signals in the frequency domain. The system 600 may include a primary path 652 supplying a time dependent primary propagation path $P_{r,m}[n]$.

The system 600 may receive at least one broadband reference signal $x_r[n]$. The broadband reference signal $x_r[n]$ may be supplied to a broadband adaptive filter 674. The broadband adaptive filter 674 may filter the broadband reference signal $x_r[n]$ and generate a broadband secondary signal $y_l[n]$.

The broadband reference signal $x_r[n]$ may be provided to a Fast Fourier Transform block 664. An FFT may be applied to the broadband reference signal $x_r[n]$ to provide a time dependent reference signal $X_r[k,n]$ in the frequency domain to the secondary path estimate block 658.

The binary limiter 660 may provide a time dependent reference signal $\hat{X}_r[k, n]$ in the frequency domain to the secondary path estimate block 658.

The secondary path estimate block 658 may estimate a secondary path for each the time domain and the frequency domain and determine an estimated secondary path in the frequency domain $\hat{S}_{l,m}[k]$ and an estimated secondary path in the time domain $\hat{s}_{l,m}[k]$. The secondary path estimate block 158 may provide a R×L×M matrix to a broadband least mean squared block 670.

The broadband least mean square (LMS) block 670 may be configured to update the adaptive filter coefficients.

An inverse FFT may then be applied to this signal at the IFFT bock 672. An R×L matrix may then be supplied to a broadband adaptive filter 674.

The broadband adaptive filter 674 may supply the broadband secondary source signal $y_l[n]$ to a secondary source 682. The secondary source signal $y_l[n]$ may then be passed to a secondary path 676.

At summation 678, the secondary path 676 and primary path 652 are summed, resulting in an error signal $e_m[n]$. The error signal $e_m[n]$ may be acquired from the input sensors 110 such as a microphone. The summed signal may be input into a Fast Fourier Transform 680 forming an estimated error signal $E_m[k,n]$.

Accordingly, a causality based binary limiter is developed to be applied to the error and/or reference signals of a feedforward/feedback ANC system.

The embodiments of the present disclosure generally provide for a plurality of circuits, electrical devices, and at least one controller. All references to the circuits, the at least one controller, and other electrical devices and the functionality provided by each, are not intended to be limited to encompassing only what is illustrated and described herein. While particular labels may be assigned to the various circuit(s), controller(s) and other electrical devices disclosed, such labels are not intended to limit the scope of operation for the various circuit(s), controller(s) and other electrical devices. Such circuit(s), controller(s) and other electrical devices may be combined with each other and/or separated in any manner based on the particular type of electrical implementation that is desired.

It is recognized that any controller as disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any controller as disclosed utilizes any one or more microprocessors to execute a computer-program that is embodied in a non-transitory computer readable medium that is programmed to perform any number of the functions as disclosed. Further, any controller as provided herein includes a housing and the various number of microprocessors, integrated circuits, and memory devices ((e.g., FLASH, random access memory (RAM), read only memory (ROM), electrically programmable read only memory (EPROM), electrically erasable programmable read only memory (EEPROM)) positioned within the housing. The controller(s) as disclosed also include hardware based inputs and outputs for receiving and transmitting data, respectively from and to other hardware based devices as discussed herein.

What is claimed:

1. A propagation delay identification system for active noise cancelation for a vehicle audio system, comprising:

at least one sensor configured to transmit sensor data indicative of acceleration data, hammer data and microphone data;

at least one output sensor configured to transmit an impulse response;

a processor being programmed to:

receive the sensor data and pulse function, identify a propagation path delay between the microphone data and a cross-correlation between the acceleration data and hammer data;

generate a source pulse function;

apply a bandpass filter to the pulse function;

identify a secondary path delay based on an arrival time of peak energy of a convolution of the impulse response and filtered pulse function; and apply a binary limiter to a reference signal in response to the secondary path delay exceeding the propagation path delay to reduce boosting of an audio signal based on coherent reference and error signals.

2. The system of claim 1, wherein the identifying of the propagation path delay includes decorrelating the acceleration data via principal component analysis.

3. The system of claim 2, wherein the identifying of the propagation path delay includes applying singular value decomposition to the acceleration data.

4. The system of claim 1, wherein the identifying of the propagation path delay includes taking an absolute value of the cross-correlation.

5. The system of claim 1, wherein the bandbass filter is configured to filter at least one of sideband, passband and stopband frequencies from the pulse function.

6. The system of claim 1, wherein the processor is further configured to equalize narrowband content of the pulse function.

7. The system of claim 1, wherein the binary limiter provides a filtered reference signal to a broadband adaptive filter to generate an estimated error signal.

8. A method for identifying the propagation delay identification for active noise cancelation for a vehicle audio system, comprising:

receiving sensor data including acceleration data, hammer data, and microphone data, receiving at least one impulse response at an output sensor, identifying a propagation path delay between the microphone data and a cross-correlation between the acceleration data and hammer data;

generating a source pulse function;

applying a bandpass filter to the pulse function;

identifying a secondary path delay based on an arrival time of peak energy of a convolution of the impulse response and filtered pulse function; and applying a binary limiter to a reference signal in response to the secondary path delay exceeding the propagation path delay to reduce boosting of an audio signal based on coherent reference and error signals.

9. The method of claim 8, wherein the identifying of the propagation path delay includes decorrelating the acceleration data via principal component analysis.

10. The method of claim 9, wherein the identifying of the propagation path delay includes applying singular value decomposition to the acceleration data.

11. The method of claim 8, wherein the identifying of the propagation path delay includes taking an absolute value of the cross-correlation.

12. The method of claim 8, wherein the bandbass filter is configured to filter at least one of sideband, passband and stopband frequencies from the pulse function.

13. The method of claim 8, further comprising equalizing narrowband content of the filtered pulse function.

14. The method of claim 8, wherein the binary limiter provides a filtered reference signal to a broadband adaptive filter to generate an antinoise signal.

15. The method of claim 8, further comprising an error signal filtered by the binary limiter in order to retain only the causal frequency content of an error signal in response to the propagation path delay exceeding the secondary path delay.

16. The method of claim 8, wherein the binary limiter provides a filtered reference signal to a secondary path estimate block to provide a time dependent reference signal in the frequency domain.

* * * * *